US010609973B2

(12) United States Patent
Nguyen

(10) Patent No.: US 10,609,973 B2
(45) **Date of Patent: *Apr. 7, 2020**

(54) SYSTEMS AND METHODS FOR MAKING SOAP FLOWERS

(71) Applicant: Rose LTD, City of Industry, CA (US)

(72) Inventor: Tony Toan Nguyen, Alhambra, CA (US)

(73) Assignee: Rose LTD, City of Industry, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/428,725

(22) Filed: May 31, 2019

(65) Prior Publication Data

US 2019/0320748 A1 Oct. 24, 2019

Related U.S. Application Data

(63) Continuation-in-part of application No. 16/198,489, filed on Nov. 21, 2018, now Pat. No. 10,364,408.
(Continued)

(51) Int. Cl.

| | |
|---|---|
| ***A41G 1/00*** | (2006.01) |
| ***A41G 1/02*** | (2006.01) |
| ***B44C 5/06*** | (2006.01) |
| ***C11D 13/22*** | (2006.01) |
| ***C11D 13/18*** | (2006.01) |

(52) U.S. Cl.
CPC ..... *A41G 1/001* (2013.01); *B44C 5/06* (2013.01); *C11D 13/18* (2013.01); *C11D 13/22* (2013.01)

(58) Field of Classification Search
None
See application file for complete search history.

(56) References Cited

U.S. PATENT DOCUMENTS

| | | | | |
|---|---|---|---|---|
| 10,364,408 | B1 * | 7/2019 | Nguyen | C11D 17/00 |
| 2015/0201690 | A1 | 7/2015 | Hazawa | |
| 2016/0296426 | A1 | 10/2016 | Yazbek | |

FOREIGN PATENT DOCUMENTS

| | | | |
|---|---|---|---|
| CN | 103215149 | B | 2/2015 |
| EP | 2886636 | A1 | 6/2015 |

(Continued)

OTHER PUBLICATIONS

Machine Translation of Japanese Patent 5-17800, Date Unknown.*

*Primary Examiner* — Jeffry H Aftergut
(74) *Attorney, Agent, or Firm* — Knobbe, Martens, Olson & Bear LLP

(57) ABSTRACT

Methods and systems for making artificial flowers are disclosed. The method can include wrapping a first flower wrapper having between 1 and 5 petals around a foam core to form a first flower construct, or bud. The method can include wrapping a second flower wrapper having between 1 and 5 petals around the first flower construct, or bud. The method can include wrapping a third flower wrapper having between 1 and 5 petals around the second flower construct. The method can include wrapping additional layers of flower wrappers around flower constructs, including, but not limited to, 3 more layers of flower wrappers. Wrapping a flower wrapper around a core or a flower construct may be done manually or in an automated fashion. Wrapping a flower wrapper around a core or a flower construct may be done petal by petal or all petals simultaneously.

20 Claims, 41 Drawing Sheets

Related U.S. Application Data

(60) Provisional application No. 62/662,146, filed on Apr. 24, 2018.

(56) References Cited

FOREIGN PATENT DOCUMENTS

| | | | | |
|---|---|---|---|---|
| JP | 01178599 | A | | 7/1989 |
| JP | 04245902 | A | | 9/1992 |
| JP | 5-17800 | A | * | 1/1993 |
| JP | 2012021246 | A | | 2/2012 |
| TW | 201617240 | A | | 5/2016 |
| WO | WO 2008/004793 | A2 | | 1/2008 |
| WO | WO 2014/027493 | A1 | | 2/2014 |

* cited by examiner

SYSTEMS AND METHODS FOR MAKING SOAP FLOWERS

CROSS-REFERENCE TO RELATED APPLICATIONS

This application is a continuation in part of U.S. application Ser. No. 16/198,489, entitled SYSTEMS AND METHODS FOR MAKING SOAP FLOWERS, filed on Nov. 21, 2018, which claims the benefit of U.S. Provisional Application No. 62/662,146, entitled SYSTEMS AND METHODS FOR MAKING SOAP FLOWERS, filed on Apr. 24, 2018; the disclosure of each of the foregoing of which is hereby incorporated by reference in their entireties.

BACKGROUND

Field of Use

The present disclosure relates in some aspects to soap flowers and methods for creating the soap flowers, and including systems and methods for producing soap flowers, which may be used in flower arrangements.

Description of the Related Art

Artificial flowers are typically made out of silk, cloth, paper, polyester, nylon, glass, or plastic. Current processes for manufacturing artificial flowers add single petal layers to a center petal holder. Faster, more automated, less expensive processes that do not in some cases require separate attachment of individual petals together to form a flower would be desirable.

SUMMARY

Some embodiments of the invention disclosed herein are directed to artificial decorative items, including but not limited to flowers, and methods for producing such artificial decorative items, e.g., flowers.

In some embodiments, a method to assemble an artificial flower can comprise first stacking a plurality of soap sheets, and pressing a first stamp into the plurality of soap sheets to produce a column of flower wraps. In some embodiments, the column of flower wraps can comprise at least two flower wraps. In some embodiments, the first stamp can comprise a shape corresponding to that of the flower wrap. In some embodiments, the first stamp can comprise a peg.

The method can comprise separating a plurality of individual flower wraps from the column of flower wraps. An individual flower wrap of the plurality of flower wraps can comprise a central hub, a plurality of petals, and/or a hole. The plurality of petals can extend radially outward from the central hub. The central hub and plurality of petals can be integrally formed with each other. The method can also comprise pressing a second stamp to embed a detail on at least one flower petal of the flower wrap. The detail can comprise a texture. The method can comprise creating an artificial flower construct. Creating the artificial flower construct can comprise wrapping the first flower wrap of the plurality of flower wraps around a core using an adhesive, folding each of the petals of the first flower wrap of the plurality of flower wraps around the core using an adhesive, layering a second flower wrap of the plurality of flower wraps around the first flower wrap of the plurality of flower wraps using an adhesive, folding each of the petals of the second flower wrap of the plurality of flower wraps around the first flower wrap using adhesive, layering a third flower wrap of the plurality of flower wraps around the second flower wrap of the plurality of flower wraps using an adhesive, folding each of the petals of the third flower wrap of the plurality of flower wraps around the second flower wrap of the plurality of flower wraps using an adhesive, attaching a calyx to the third flower wrap of the plurality of flower wraps using an adhesive, and/or advancing a flower mounter through the core. The flower mounter can comprise anchors, such as barbs.

In some embodiments, the soap sheets can comprise a flame retardant material. The calyx can comprise a flame retardant material.

In some embodiments, a method of assembling an artificial flower can comprise stacking a plurality of pliable material sheets, and pressing a first stamp into the plurality of pliable material sheets to produce a column of flower wraps. The column of flower wraps can comprise at least two flower wraps. The first stamp can comprise a peg. The first stamp can comprise a shape corresponding to that of the flower wrap. The method can also include separating a plurality of individual flower wraps from the column of flower wraps. An individual flower wrap of the plurality of flower wraps can comprise a central hub and a plurality of petals. The plurality of petals can extend radially outward from the central hub, and the central hub and plurality of petals can be integrally formed with each other; and creating an artificial flower construct. Creating the artificial flower construct can comprise wrapping the first flower wrap of the plurality of flower wraps around a core, folding each of the petals of the first flower wrap around the core, layering at least a second flower wrap of the plurality of flower wraps around the first flower wrap, attaching a calyx, and/or inserting a flower mounter through the core.

In some embodiments, the material sheets or calyx can comprise a flame retardant material. The method of assembling an artificial flower can further comprise advancing a flower mounter through an aperture in the core, first flower wrap, and second flower wrap. The material sheet can be soap.

In some embodiments, a method of assembling an artificial flower can comprise pressing a first stamp into at least one pliable material sheet to produce at least one flower wrap; and creating an artificial flower construct. Creating the artificial flower construct can comprise wrapping the first flower wrap around a core, and layering at least a second flower wrap around the first flower wrap.

In some embodiments, an artificial flower can be created by forming a plurality of flower wraps from stacking a plurality of soap sheets. The plurality of soap sheets can comprise a flame retardant material. The flower wraps can comprise a central hub and a plurality of petals that can extend radially outward from the central hub, the central hub and plurality of petals can be integrally formed with each other, and/or the flower wraps can be formed by pressing a first stamp into a stack of soap sheets to produce a column of flower wraps. The column of flower wraps can comprise at least two flower wraps. The first stamp can comprise a peg. The method can also include separating a plurality of individual flower wraps from the column of flower wraps; pressing a second stamp to embed a detail on at least one petal of the flower wrap; wrapping a first flower wrap of the plurality of flower wraps around a core; folding each petal of the first flower wrap; layering a second flower wrap of the plurality of flower wraps around the first flower wrap; layering a third flower wrap of the plurality of flower wraps around the second flower wrap; attaching a calyx to the third flower wrap using an adhesive, and/or advancing a flower mounter through the core. The flower mounter can comprise barbs.

In some embodiments, the flower wraps, calyx, and/or flower mounter can comprise a flame retardant material. The core can comprise of foam, cork, and/or other materials. The flower can further comprise a stem.

In some embodiments, an artificial flower can be created by forming a plurality of flower wraps from a stacking a plurality of pliable material sheets. The flower wraps can comprise a central hub and a plurality of petals can extend radially outward from the central hub. The central hub and plurality of petals can be integrally formed with each other. The flower wraps can be formed by pressing a first stamp into a stack of soap sheets to produce a column of flower wraps, separating a plurality of individual flower wraps from the column of flower wraps; wrapping a first flower wrap of the plurality of flower wraps around a core; folding each petal of the first flower wrap; layering at least a second flower wrap of the plurality of flower wraps around the first flower wrap; attaching a calyx using an adhesive; and/or inserting a flower mounter through the core.

In some embodiments, artificial flower can be created by forming a plurality of flower wraps from stacking a plurality of pliable material sheets. The flower wraps can comprise a central hub and a plurality of petals that can extend radially outward from the central hub. The central hub and plurality of petals can be integrally formed with each other. The flower wraps can be formed by pressing a first stamp into a stack of soap sheets to produce a column of flower wraps, separating a plurality of individual flower wraps from the column of flower wraps; wrapping a first flower wrap of the plurality of flower wraps around a core; folding each petal of the first flower wrap; and/or layering at least a second flower wrap of the plurality of flower wraps around the first flower wrap.

Artificial flowers and methods of creating the same can include one or more of the following. The pliable material can be soap. The excess of material created from pressing the stack of sheets can be recycled. The flower wrap can comprise a 3-petal, 4-petal, 5-petal design, or more or less petals. The flower can comprise at least a vein. The flower can comprise at least a fold. The method to assemble an artificial flower can further include at least one flower wrap to make a flower bud. The method to assemble an artificial flower can further have at least three flower wraps used to make a flower. The method to assemble an artificial flower can further have a calyx that can be used to hold the flower together. The method to assemble an artificial flower can further have a stem may be attached to the flower. The core or flower can further comprise foam. The core or flower can comprise sponge material. The method to assemble an artificial flower can comprise advancing a flower mounter comprising an elongate tubular member through an aperture in the core, first flower wrap, and second flower wrap. The second flower wrap can have the same shape as the first flower wrap. The second flower wrap can have a different shape from the first flower wrap.

In some embodiments, a method to assemble an artificial flower comprises creating a flower wrap from a stack of sheets made out of a pliable material using a first mold to make multiple flower wraps out of a single motion. The stack of individual flower wraps can then be removed from the stack of sheets. The flower wraps may have petals. A second mold may mark the flower wraps to embed a design on to the flower wrap. A first flower wrap layer may be wrapped around a core. A subsequent flower wrap layer may be wrapped around the previous flower wrap layer.

In some embodiments, the pliable material can be soap. The excess of material created from pressing the stack of sheets can be recycled. The flower wraps can comprise of a 3, 4, or 5-petal design, or include more petals. The design may comprise at least a vein. The design may comprise at least a fold. At least one flower wrap can be used to make a flower bud. In some embodiments, three or more flower wrap layers are used to make a flower. A calyx may be used to hold the flower together. A stem may be attached to the artificial flower.

In some implementations, the artificial flower may comprise a core. The artificial flower may comprise a first flower wrap made out of a pliable material wrapped around the core. The artificial flower may also comprise at least a second flower wrap made out of a pliable material. The second flower wrap layer may be wrapped around the previous flower wrap layer.

In some embodiments, a core of the flower can be made out of foam, sponge, or cork. The flower can further comprise a calyx or stem.

The method of manufacturing an artificial flower can comprise forming a plurality of flower wraps from a stack of individual blanks made out of a pliable material. The flower wraps may comprise a central hub and may have a plurality of petals extending radially outward from the central hub. The central hub and plurality of petals may be integrally formed with each other. The flower wraps may be formed by stamping the stack of individual blanks with a first mold thereby creating the flower wraps. The first mold may comprise a shape corresponding to that of the flower wrap. The method can also include separating the plurality of flower wraps from the stack of individual blanks. The method can also include marking the petal with a second mold to embed a design on to the flower petal. The method can also include wrapping a first flower wrap of the plurality of flower wraps around a core. The method can also include folding each petal of the first flower wrap and/or layering a second flower wrap around the first flower wrap.

In some embodiments, the pliable material can be soap. A third flower wrap can be wrapped around the second flower wrap. Advancing a flower mounter can include an elongate tubular member through an aperture in the core, first flower wrap, and second flower wrap. The second flower wrap may have the same shape as the first flower wrap. The second flower wrap may have a different shape from the first flower wrap.

In some implementations, an artificial flower may be created. A plurality of flower wraps can be formed from a stack of individual blanks made out of a pliable material. The flower wraps can comprise a central hub and a plurality of petals extending radially outward from the central hub. The central hub and plurality of petals may be integrally formed with each other. The flower wraps may be formed by stamping the stack of individual blanks with a first mold thereby creating the flower wraps. The first mold may comprise a shape corresponding to that of the flower wrap. The plurality of flower wraps can be separated from the stack of individual blanks. The petal(s) can be marked with a second mold to embed a design on to the flower petal(s). The first flower wrap of the plurality of flower wraps can be wrapped around a core. Each petal of the first flower wrap can be folded. At least a second flower wrap can be layered around the first flower wrap.

A method to assemble an artificial flower can comprise pressing a stamp into the plurality of pliable material sheets to produce a column of flower wraps, wherein the column of flower wraps comprises at least a first flower wrap and a second flower wrap. The stamp can further comprise a shape corresponding to the first flower wrap and the second flower wrap. The method can further comprise separating a plurality of individual flower wraps from the column of flower wraps, wherein each flower wrap comprises a central hub and a plurality of petals, wherein the plurality of petals extends radially outward from the central hub, and the central hub and plurality of petals are integrally formed with each other. The method can further comprise creating an artificial flower construct, wherein creating the artificial flower construct comprises wrapping the plurality of petals of a first flower wrap of the plurality of flower wraps around the plurality of petals to make the artificial flower construct. An artificial flower can be created by the aforementioned method.

In some embodiments, the first flower wrap of the plurality of flower wraps are wrapped by folding each of the petals around a core. In some embodiments, the second flower wrap of the plurality of flower wraps is layered around the first flower wrap of the plurality of flower wraps and each of the petals of the second flower wrap of the plurality of flower wraps are folded around the first flower wrap to make a two layer artificial flower. In some embodiments, the third flower wrap of the plurality of flower wraps is layered around the second flower wrap of the plurality of flower wraps and each of the petals of the third flower wrap of the plurality of flower wraps are folded around the second flower wrap of the plurality of flower wraps to make a three layer artificial flower. In some embodiments, a flower mounter can be inserted into the artificial flower construct. In some embodiments, the flower mounter comprises a snap-lock end that is configured to couple to a preformed hole of a substrate. In some embodiments, the pliable material sheets comprises flame retardant material. In some embodiments, the core comprises flame retardant material.

An artificial flower can comprise of a first flower wrap comprising a pliable material made from a first stamp comprising a first central hub and a first plurality of petals, wherein the first plurality of petals extends radially outward from the first central hub, and the first central hub and first plurality of petals are integrally formed with each other. The artificial flower can further comprise a second flower wrap comprising the pliable material made from a second stamp comprising a second central hub and a second plurality of petals, wherein the second plurality of petals extends radially outward from the second central hub, and the second central hub and second plurality of petals are integrally formed with each other. The artificial flower can further comprise a third flower wrap comprising the pliable material made from a third stamp comprising a third central hub and a third plurality of petals, wherein the third plurality of petals extends radially outward from the third central hub, and the third central hub and third plurality of petals are integrally formed with each other, wherein the first plurality of petals of the first flower wrap are wrapped around each other to make an artificial flower construct, the second plurality of petals of the second flower wrap are wrapped and folded over the artificial construct, and the third plurality of petals of the third flower wrap are wrapped and folded over the second flower wrap.

In some embodiments, a first flower wrap of the plurality of flower wraps is wrapped and folded over a core. In some embodiments, the artificial flower further comprises a calyx attached to the third flower wrap. In some embodiments, the artificial flower further comprises a flower mounter that is inserted into the artificial construct. In some embodiments, the flower mounter comprises a snap-lock end that is configured to couple to a preformed hole of a substrate. In some embodiments, the pliable material comprises flame retardant material. In some embodiments, the core comprises flame retardant material. In some embodiments, the pliable material comprises soap.

BRIEF DESCRIPTION OF THE DRAWINGS

The features disclosed herein are described below with reference to the drawings. The drawings are provided to illustrate embodiments of the inventions described herein and not to limit the scope thereof.

FIG. 2A shows a side view of an example soap flower. FIG. 2B shows a front view of an example soap flower. FIG. 2C shows a view of the calyx of an example soap flower.

FIG. 4A shows an embodiment of an individual flower wrapper stamp. FIG. 4B shows a column of flower wraps and the stack of soap sheets out of which they were stamped out of FIGS. 4C-4D show various examples of flower wrapper stamps arranged on a roller or a foot. FIGS. 4E-4I show various embodiments of flower wrappers.

DETAILED DESCRIPTION

Overview

Embodiments described herein relate to artificial decorative items, including but not limited to flowers, and methods for producing such artificial decorative items, e.g., flowers, soap flowers. Real flowers may be used in flower arrangements, however, due to the shelf life of a real flower, such real flowers will die, wither, or rot after a relatively short time has elapsed. Artificial or faux flowers made out of silk, cloth, paper, polyester, nylon, glass, or plastic may alternatively be used. However, such artificial flowers lack certain characteristics, e.g., an aroma of natural flowers, and thus may not appeal to potential customers. As disclosed herein, artificial or faux flowers may be formed out of soap and/or other materials to address some shortcomings of other types of artificial flowers. For example, soap can advantageously be scented to increase their appeal, flowers, e.g., the soap material out of which these flowers are made. Methods for producing soap flowers may comprise carving and/or hand-molding processes. Carving soap flowers may involve cutting or sculpting the flower out of soap. Hand-molding soap flowers may involve folding, pinching, trimming, and/or bending soap to create an artificial flower. Both carving and hand-molding are generally expensive and labor-intensive processes. Soap flowers may also be constructed by adding single petal layers to a center petal holder. However, this process can be time consuming and expensive. It is desirable to reduce or eliminate expenses and amount of labor required to make artificial soap flowers. One or more of the methods disclosed herein involve a process that uses flower wraps (also called flower wrappers) to advantageously reduce the amount of labor or time needed to construct faux flowers. A central structure may advantageously be used to provide stability and/or to reduce the fragility (e.g., increase the sturdiness, durability, or toughness) of the artificial soap flower. Such cores may advantageously reinforce the shape of the faux flower as it is being arranged, thereby preventing and/or reducing the amount of deformation of the flower when contacted against a substrate.

Figure 1:
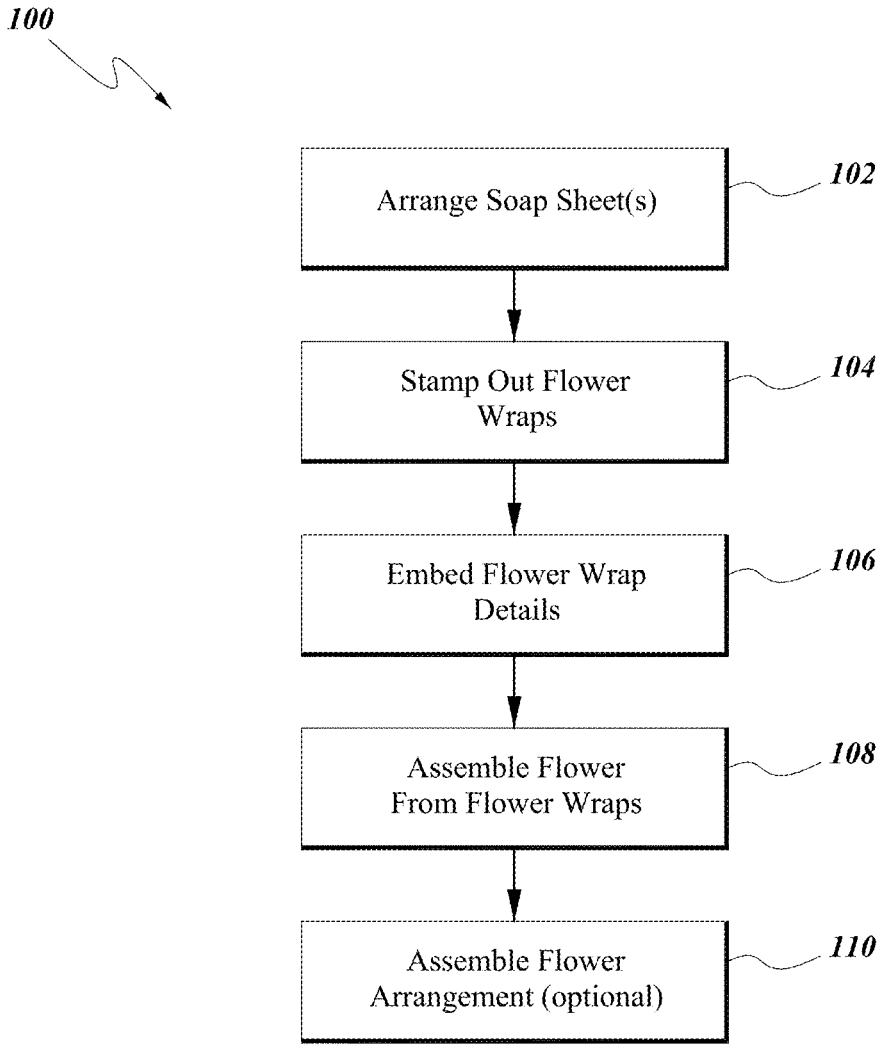
FIG. 1 shows a flowchart of a method for producing soap flowers.

FIG. 1 shows a flowchart of the method for producing soap flowers 100. The method 100 may be used to produce soap flowers more cheaply and efficiently than was previously possible. The method 100 allows mass-production of decorative and sturdy artificial or faux flowers. In step one 102, sheets of a pliable material (e.g., soap, candy, sugar, chocolate, taffy, plastic) can be arranged. A single sheet or multiple sheets can be used. The sheets can be thin sheets of soap or other pliable materials. The sheets can be arranged by stacking them upon one another. The sheets may act as blanks for the production of artificial decorative items.

In step two 104, the soap sheet(s) may be transferred to a stamping mechanism that stamps out flower wraps (e.g., individual flower wraps or columns of flower wraps). Various embodiments of stamping mechanisms are described herein. Flower wraps can be a single layer of pliable material, e.g., soap. The flower wraps may have a central shape with a center portion and multiple petal portions extending therefrom. The flower wraps may have a plurality of number of petals. The flower wraps can then be easily wrapped or folded into an artificial soap flower. Flower wraps may advantageously eliminate the need to form a faux flower petal-by-petal.

In step three 106, details may be added to or embedded in the flower wraps. Examples of details that may be embedded or added are disclosed herein.

In step four 108, the flower wraps can be folded, wrapped, or shaped (with or without a core) to produce artificial flowers, e.g., soap flowers. Some of the methods disclosed herein may be used to produce flowers without cores (e.g., daisies, anemone, amaryllis, antherium, sunflowers, bougainvillea, hibiscus, magnolias, wallflowers, plumerias, jasmine, poppy, daffodils, orchids, poinsettias, petunias). Some of the methods disclosed herein may be used to produce flowers with cores (e.g., roses, lilies, poppies, lotus, gardenias, marigolds, chrysanthemum, carnations, gerbera, freesia, hydrangea, protea, tulips).

In step five 110, the artificial flowers can be placed in arrangements. For example, the artificial flowers produced according to method 100 may be fixed to a foam core having a shape (e.g., a shape of a bear, a shape of a heart, etc.). In this way, the method 100 may be used to easily create long-lasting and aesthetic flower arrangements.

Soap Flower

Figure 2A:
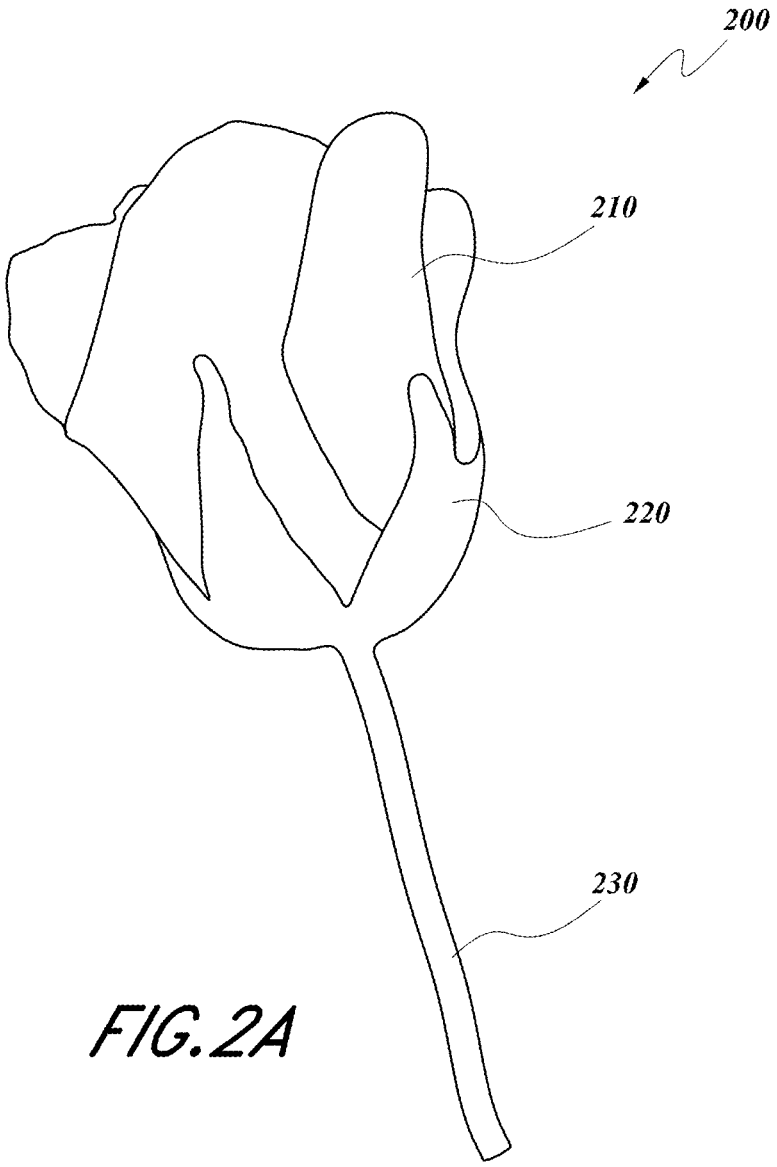
FIGS. 2A-2C depict various views of an example of a soap flower.
Figure 2B:
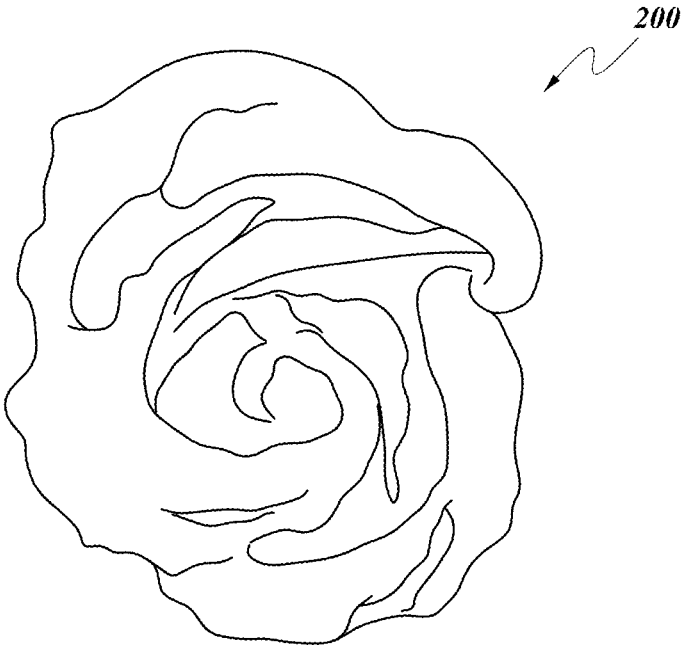
Figure 2C:
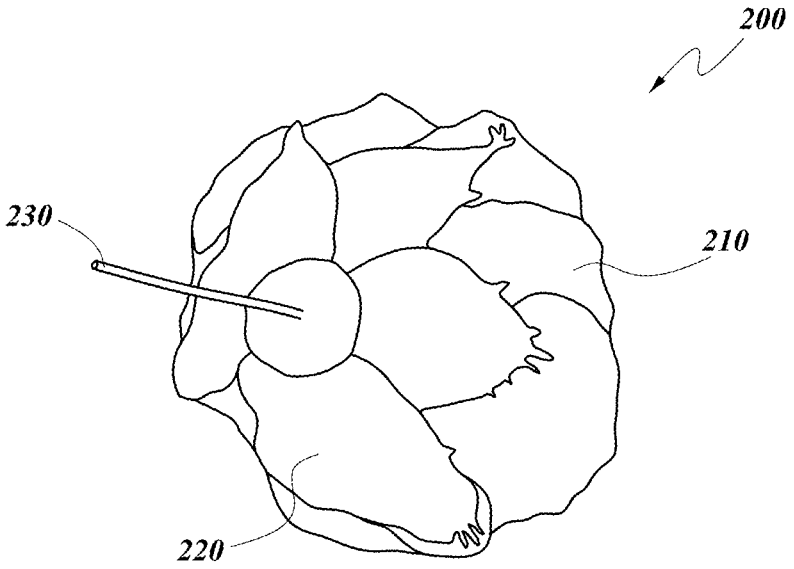

FIG. 2A illustrates an example of an artificial flower 200, e.g., a soap flower, which may be produced according to the methods disclosed herein. FIG. 2A illustrates an example soap flower 200 with petals 210, a calyx 220, and a stem 230. FIG. 2B shows a top view of an example flower 200. FIG. 2C illustrates a rear, bottom, or base view of an example artificial flower 200 with petals 210, calyx 220, and stem 230. The artificial flower 200 may comprise of other or additional parts (e.g., additional faux parts, such as, but not limited to, anthers, filaments, stigmas, styles, ovaries, ovules, sepals, pistils, seeds, peduncles, leaves, branches, roots, shoots, tendrils, seeds, caps, lobes, calyx, or stems). In some embodiments, other decorative items are added, such as, but not limited to organisms such as hummingbirds, butterflies, ladybugs, and the like (e.g., insects, birds, lizards, mammals, amphibians, invertebrates). In some embodiments, faux dew is added. In some embodiments, textures are added to the soap flower 200. The flower petals 210, stem 230, calyx 220, and/or any other faux or false parts may also be made out of soap or other pliable materials such as, but not limited to, plastic, rubber, chocolate, sugar, taffy, and other pliable substances. In some embodiments, each of the petals are the same size and/or shape. In some embodiments, some petals could have different sizes and/or shapes with respect to other petals.

In some embodiments, the soap flowers further comprise one, two, or more flame retardant materials. All or any number of parts of the artificial flower, such as, but not limited to, the flower wrappers, calyx, and/or flower mounter, can include flame retardant material. In some embodiments, one or more parts of the artificial flower do not comprise flame retardant materials. The flame retardant material can be mixed into the material used to create the soap flower petals. The flame retardant material can be mixed into the materials used to make the calyx 200, stem 230, and other aforementioned additional parts and accessories. In some embodiments, the flame retardant material include any of, or any combination of one, two, three, four, or more of the following compounds. Such compounds can include, but are not limited to, aluminum hydroxide (ATH), magnesium hydroxide (MDH), huntite, and hydromagnesite, various hydrates, red phosphorus, and boron compounds, such as borates. In some embodiments, the flame retardant material includes organophosphorus compounds. Organophosphorus compounds can include organophosphates (e.g., triphenyl phosphate (TPP), resorcinol bis(diphenylphosphate) (RDP), bisphenol A diphenyl phosphate (BADP), and tricresyl phosphate (TCP)). phosphonates (e.g., dimethyl methylphosphonate (DMMP); and phosphinates such as aluminium diethyl phosphinate. In one class of flame retardants, compounds include both phosphorus and a halogen. Such compounds include tris(2,3-dibromopropyl) phosphate (brominated tris) and chlorinated organophosphates such as tris(1,3-dichloro-2-propyl)phosphate (chlorinated tris or TDCPP) and tetrakis(2-chlorethyl)dichloroisopentyldiphosphate (V6). In some embodiments, the flame retardant material includes organohalogen compounds. Organohalogen compounds can include organochlorines (e.g., chlorendic acid derivatives and chlorinated paraffins), organobromines (e.g., decabromodiphenyl ether (decaBDE)), decabromodiphenyl ethane (a replacement for decaBDE), polymeric brominated compounds (e.g., brominated polystyrenes), brominated carbonate oligomers (BCOs), brominated epoxy oligomers (BEOs), tetrabromophthalic anyhydride, tetrabromobisphenol A (TBBPA), and hexabromocyclododecane (HBCD). Some halogenated flame retardants can be used in conjunction with a synergist to enhance their efficiency. Antimony trioxide is widely used but other forms of antimony such as pentoxide and sodium antimonate can also be used. In some embodiments, three to four parts of halogenated flame retardants are used to one part of antimony oxide or another antimony compound on a weight basis. In some embodiments, using more than the 4:1 ratio offers little additional protection. The stoichiometric ratio of chlorine to antimony in antimony trichloride is 3:1. Formulations in different applications will depend on thermal stability, cost, tinting strength, change in physical properties, smoke considerations, streaking, blend ability, and the flame retardant specification. In some embodiments, the flame retardant comprises 50%, 45%, 40%, 35%, 30%, 25%, 20%, 15%, 10%, 5%, or less of the weight of the materials used to make the soap petals, or ranges including any two of the foregoing values In some embodiments, the flame retardant is can be 10%, 15%, 20%, 25%, 30%, 35%, 40%, 45%, 50% or more of the weight of the materials used to make the soap petals, or ranges including any two of the foregoing values. In some embodiments, additional coloring components are used to offset the color of using flame retardant materials in the soap petals.

The flower 200 may comprise multiple flower wraps, each of which comprises one or more petals 210 integrally formed together, e.g., via a stamping process rather than petals 210 being attached together one by one. The multiple flower wraps can be wrapped or stacked consecutively, and the petals 210 may be bent or folded into a desired shape, e.g., a natural shape. In some embodiments, each flower wrapper has a different number of petals 210. In some embodiments, each flower wrapper has the same number of petals 210. In some embodiments, some flower wrappers have the same number of petals 210 and some flower wrappers have different numbers of petals. In some embodiments, the flower 200 is constructed out of one or more flower wrappers having only (e.g., no more than) 1 petal. In some embodiments, the flower 200 is constructed out of one or more flower wrappers, at least one of which has about, at least about, or no more than about 2 petals, 3 petals, 4 petals, 5 petals, 6 petals, 7 petals, 8 petals, 9 petals, 10 petals, 11 petals, 12 petals, or etc., or any ranges incorporating any two of the aforementioned values. In some embodiments, the flower 200 is constructed out of one or more flower wrappers, at least one of which has about, at least about, or no more than about 30 petals or less, 25 petals or less, 20 petals or less, 18 petals or less, 16 petals or less, 14 petals or less, 12 petals or less, 10 petals or less, 8 petals or less, 6 petals or less, 4 petals or less, 2 petals or less, or other numbers of petals that may practically allow folding a faux flower, or any ranges incorporating any two of the aforementioned values. In some embodiments, each consecutive flower wrapper layer has one more petal than the last flower wrapper used, e.g., the first flower wrapper layer used inside. In some embodiments, each consecutive flower wrapper layer has two, three, four or more than four more petals compared with the last flower wrapper.

In other embodiments, the flower wrappers have petal details such as, but not limited to, veins, blemishes, creases, ridges, bumps, insects, textures, scents, paints, glitters, sheens, anti-sticking materials, or other types of features embedded into or applied onto the sheets out of which the flower wrappers are made, e.g., soap sheets. In some embodiments, substances are applied to better increase the structure of the folded flower and/or to prevent drying (e.g., adhesives, water, oils, sealant).

As shown in FIGS. 2A and 2C, the flower 200 may further comprise a calyx 220. In some embodiments, the calyx 220 is not used. For example, when a calyx 220 is not used, the artificial flower may be fused directly to a mounting surface, e.g., the outermost flower wrapper layer may be affixed to a mounting surface. In some embodiments, the calyx 220 has adhesive(s) on at least a portion of its inner-surface to improve adherence with/to the soap flower. In some embodiments, the calyx 220 is interchangeable and/or removable. In some embodiments, the calyx 220 has a hole that may allow a wire or stem to be attached. In some embodiments, the calyx 220 has calyx details (e.g., veins, blemishes, creases, ridges, bumps, insects, textures, scents, paints, glitters, sheens, anti-sticking materials, or other types of features) embedded into or applied onto the calyx. In some embodiments, aforementioned faux flower parts are attached to the calyx. The calyx 220 may be formed out of plastic, rubber, chocolate, sugar, taffy, and other pliable substances, depending on the application. For example, when the faux flower is to be used as decoration on a cake, the calyx 220 may be made out of chocolate, frosting, or candy. When the faux flower is made out of soap for used in a scented, long-lasting flower arrangement, the calyx 220 may be made out of plastic or soap.

In some embodiments, the flowers are mounted on an artificial stem 230. The flower may be mounted after formation, e.g., sticking a wire into the bottom of the flower 200 or calyx 220. The flower may be mounted prior to formation, e.g., a core around which the flower wrappers are wrapped may include a wire extending therefrom, which may be sequentially passed through the flower wrappers as or before the petals are wrapped around the core to form the flower. In some embodiments, one or more of the faux flower parts are attached to the stem 230. In some embodiments, the stem 230 has calyx (e.g., veins, blemishes, creases, ridges, bumps, insects, texture, scents, paints, glitters, sheens, anti-sticking materials, or other types of features) embedded into or applied onto the aforementioned faux flower parts.

Figure 3A:
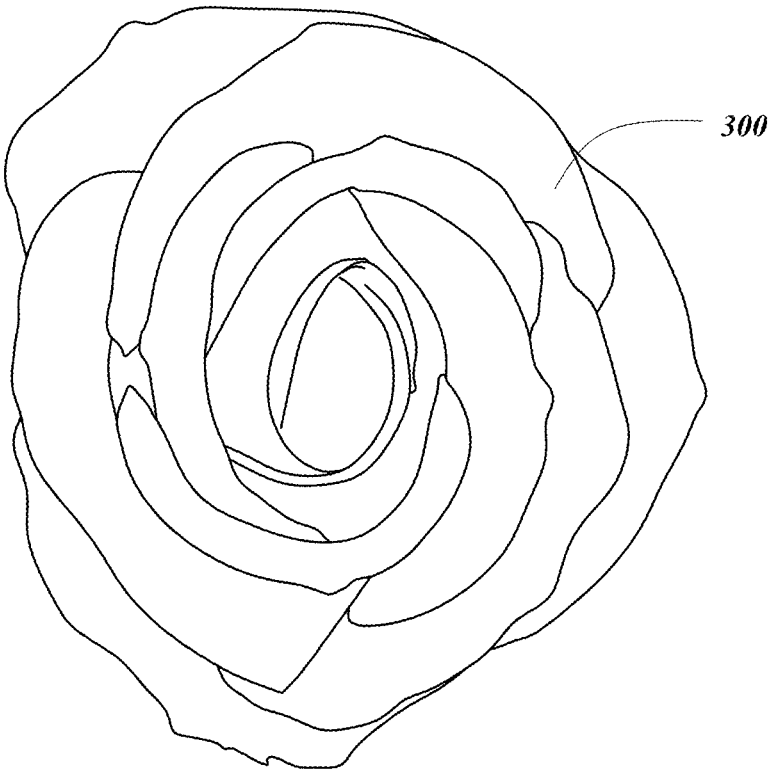
FIGS. 3A-3B depict an open flower and a flower bud design, respectively.
Figure 3B:
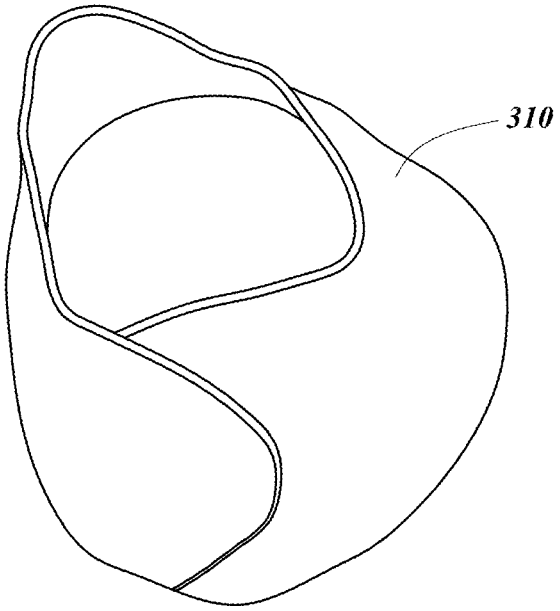

Depending on the number of petals a flower wrap has, the layers of flower wraps used, the way the flower wraps may be wrapped, and/or the use of other faux plant parts, many different flower designs may be made. For example, FIG. 3A represents a view of an example blooming flower design 300. FIG. 3B shows an example flower bud design 310.

Systems and Methods for Making Soap Flowers

One or more of the systems and methods for making soap flowers disclosed herein advantageously allow soap flowers to be mass-produced and allow advantageous creation of lifelike faux flowers. Flower wraps with different characteristics (e.g., number of petals, different shapes, different sizes, colors, etc.) may first be made (e.g., by a flower wrap press, flower wrapper roller, manual stamping, laser cutting, high-pressure water cutting, etc.). The systems may simultaneously produce multiple flower wraps in a single layer. The system may simultaneously produce flower wraps in stacks, e.g., multiple layers of flower wraps at once. In some embodiments, the system simultaneously produces varying quantities of flower wraps, including but not limited to about, at least about, or no more than about 10-1000, 20-950, 30-900, 40-850, 50-800, 60-750, 70-700, 80-650, 90-600, 100-550, 110-500, 120-450, 130-400, 140-350, 150-300, 160-250, 170-200, or any ranges incorporating any two of the aforementioned values. In some embodiments, the system simultaneously produces varying quantities of flower wraps, including but not limited to, about, at least about, or no more than about 1500 or less, 1000 or less, 900 or less, 800 or less, 700 or less, 600 or less, 500 or less, 400 or less, 300 or less, 200 or less, 100 or less, or any ranges incorporating any two of the aforementioned values. In some embodiments, the system simultaneously produces varying quantities of flower wraps, including but not limited to about, at least about, or no more than about 10 or more, 20 or more, 30 or more, 40 or more, 50 or more, 100 or more, 200 or more, 300 or more, 400 or more, 500 or more, 600 or more, 700 or more, 800 or more, 900 or more, 1000 or more, 1500 or more, or any ranges incorporating any two of the aforementioned values.

Figure 4A:
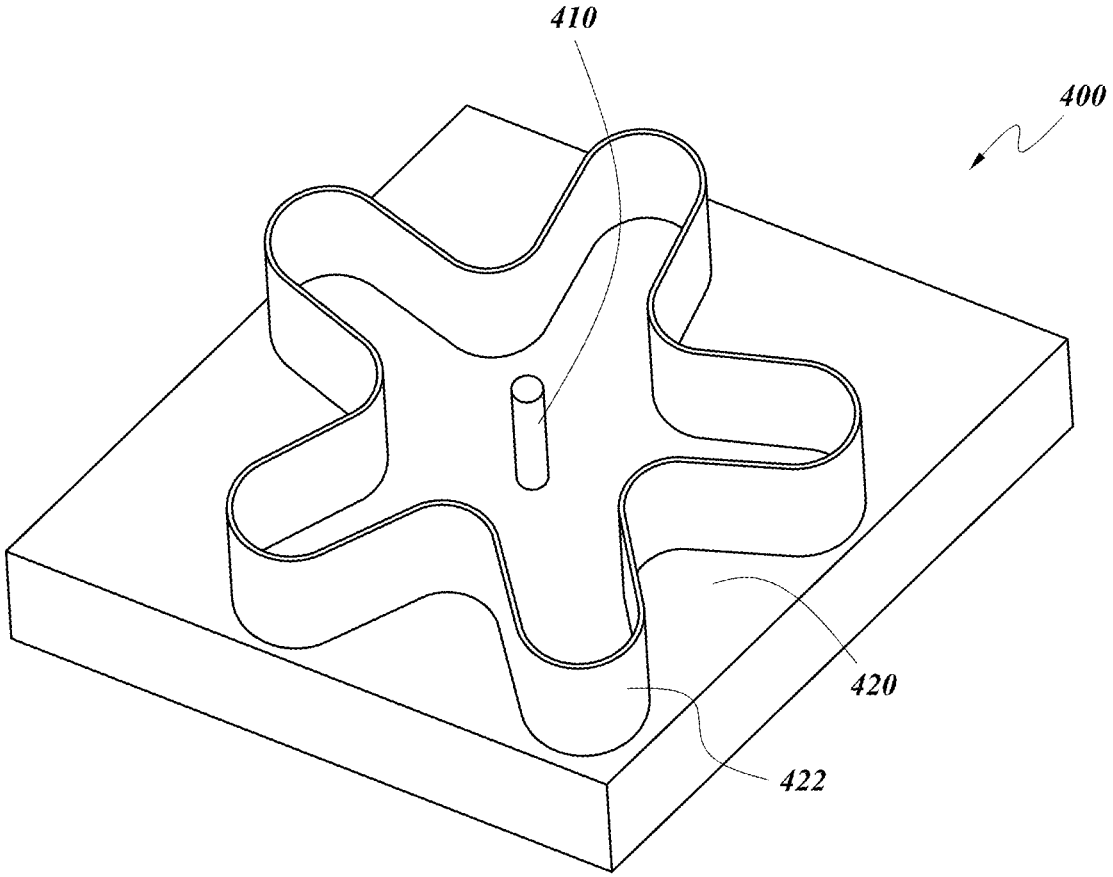
FIGS. 4A-4I depict embodiments of flower wrap stamps, columns of flower wraps, and individual varieties of flower wraps.

FIG. 4A depicts an example of a 5-petal flower wrap stamp 400. In some embodiments, a 1-petal design, 2-petal design, 3-petal design, 4-petal design, 5-petal design, 6-petal design, 7-petal design, 8-petal design, 9-petal design etc. is used. The flower wrappers can also have about, at least about, or no more than about 10 or less petals design, 20 or less petals design, or other numbers of petals that allow folding or wrapping a faux flower, or any ranges incorporating any two of the aforementioned values. In some embodiments, the stamp 400 has a depth of about, at least about, or no more than about 10 mm or less, 100 mm or less, 1000 mm or less, 10000 mm or less, or other dimensions that allow for effective stamping, or any ranges incorporating any two of the aforementioned values.

The stamp 400 may contain a peg 410 to create a hole in the flower wrap. In some embodiments, there is no peg 410. In some embodiments, the peg 410 is off center. In some embodiments, the peg 410 is centered. In some embodiments, the peg 410 has a circular shape or a square shape or a triangular shape. In some embodiments, the peg 410 is shaped differently. The stamp 400 may have a stamp body 420. In some embodiments, the stamp body 420 is made out of metal. In some embodiments, the stamp body 420 is made out of plastic. In some embodiments, the stamp body 420 is made out of wood. In some embodiments, the stamp body 420 is made out of stone. In some embodiments, the stamp has a non-stick coating. In some embodiments, the stamp has a hydrophobic coating. In some embodiments, the stamp 400 has a hydrophilic coating. In some embodiments, glitter, paint, scent chemicals, and other materials are coated on the stamp to impart the materials onto the flower wraps. In this example, the stamp 400 may either have a raised edge 422 like a cookie cutter. In some embodiments, there is no raised edge and the stamp design is indented into the stamp body 420. The edge 422 may have a beveled edge, sharpened edge, serrated edge, or any type of cutting edge. The stamp 400 may have an inner portion that slides in and out of the raised edge 422 to eject stacks of flower wraps.

Figure 4B:
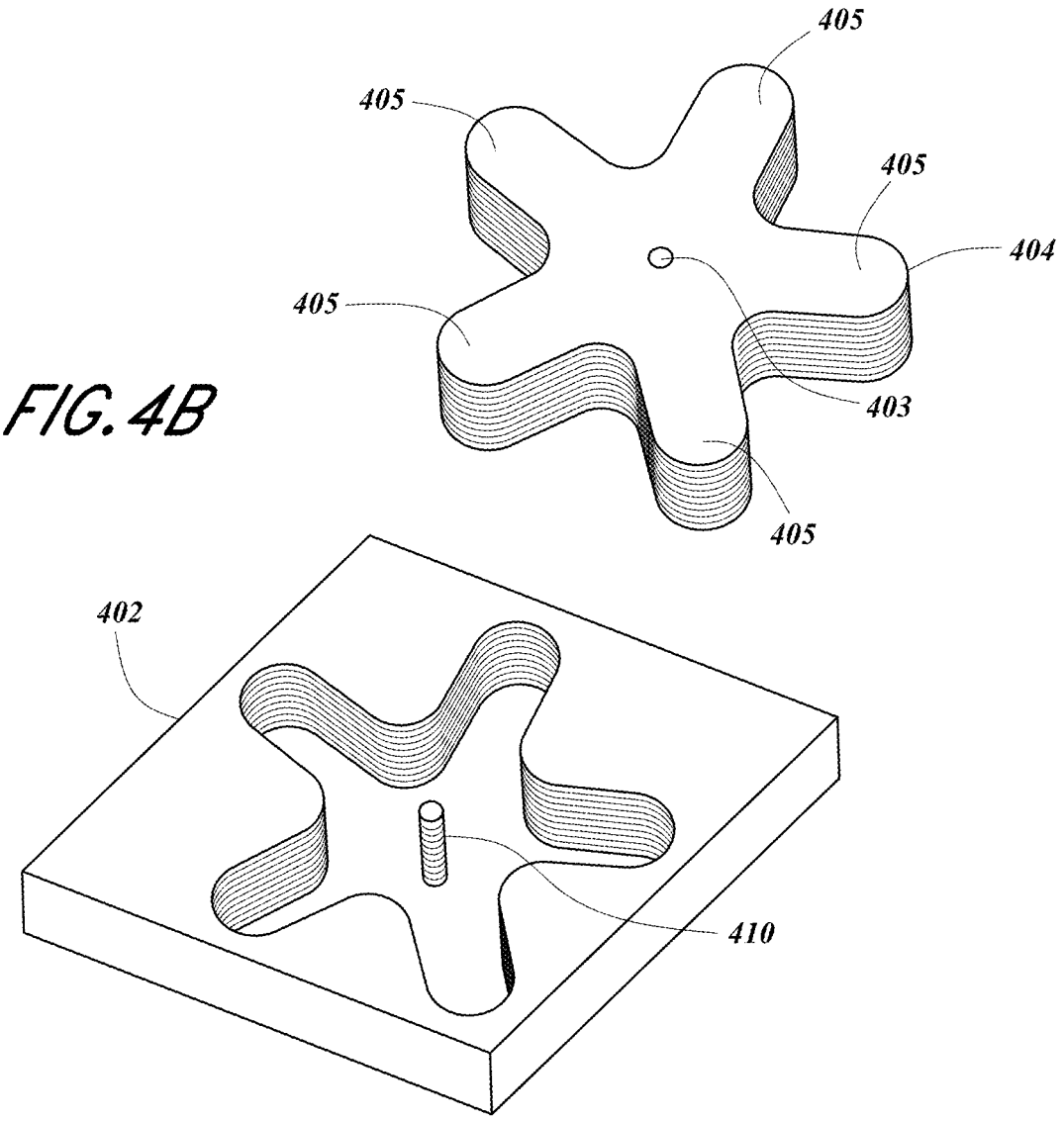

FIG. 4B depicts an example of a column of an array of flower wraps 404 stamped out of a used soap sheet stack 402. The soap sheet stack 402 can include a plurality of individual sheets pre-cut to a desired thickness. In other embodiments, the stack 402 is uncut and cut later to individual thicknesses after the column 404 is created. In some embodiments, the column 404 has about, at least about, or no more than about a 1-petal design, 2-petal design, 3-petal design, 4-petal design, 5-petal design, 6-petal design, 7-petal design, 8-petal design, 9-petal design, etc. The column 404 can also have about, at least about, or no more than about 10 or less petals design, a 20 or less petals design, or any ranges incorporating any two of the aforementioned values. The column of flower wraps 404 has a hole 403 created by the peg. In some embodiments, the flower wraps have petals 405, e.g., five petals extending radially outward from the center. In some embodiments, the column does not have a hole 403. The column of flower wraps 404 may allow the advantageous simultaneous creation of numerous individual flower wrappers, instead of requiring a user to slice a log of soap to create individual flower wrappers. In some embodiments, excess soap from a used soap sheet stack 402 is recycled (e.g., via heating; addition of oil, water, lye, and/or other ingredients; or other processes) to form additional soap sheets. In some embodiments, the used soap sheet stack 402 is used again for a stamp press. In some embodiments, the used soap sheet stack 402 is thrown away.

In some embodiments, the stamp is used in conjunction with a press arm or a roller. The press arm or rollers may be hydraulically, electrically, or manually powered.

Figure 4C:
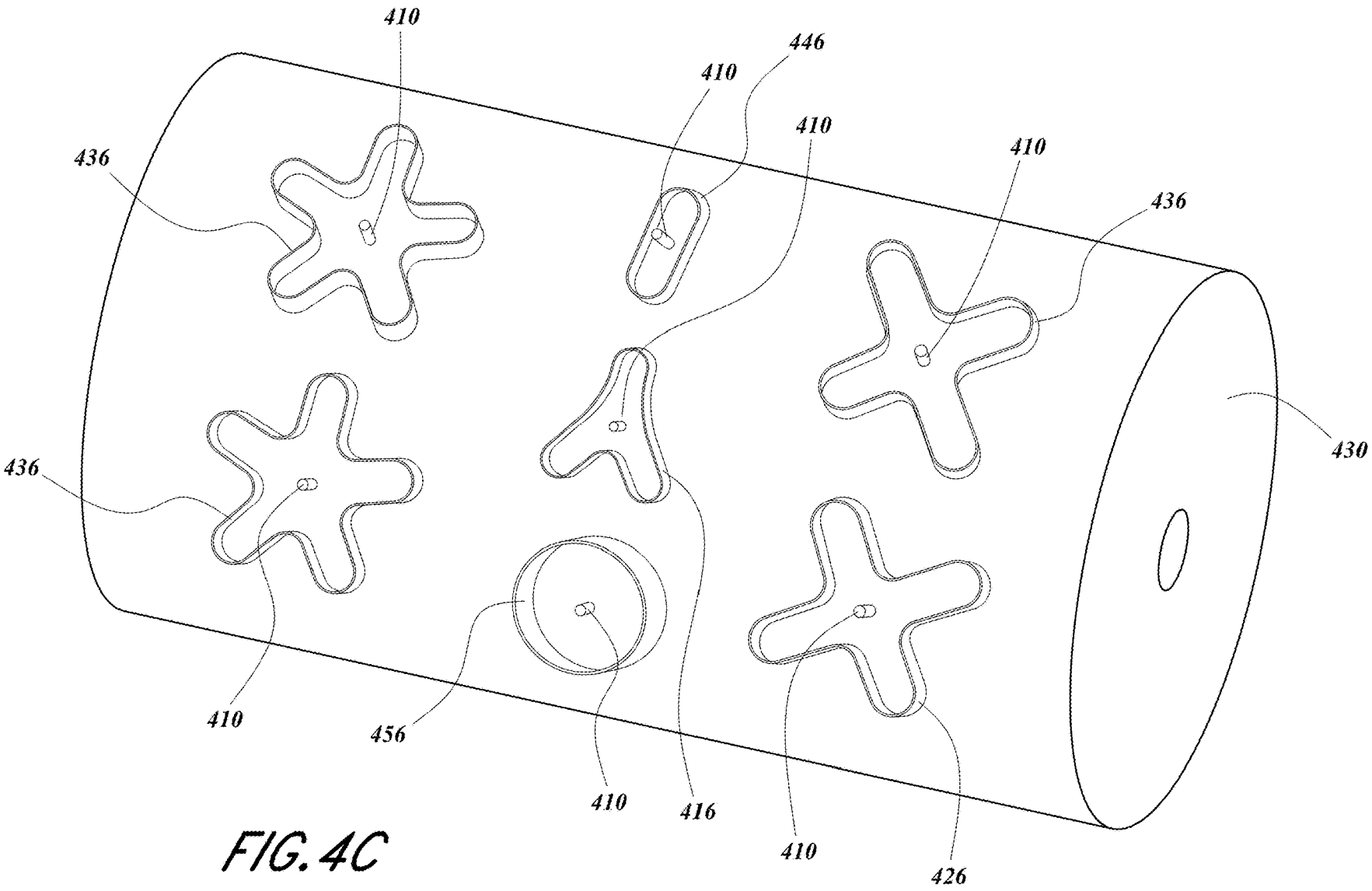

FIG. 4C depicts an example of a plurality of different stamps 426, 436, 446, 456 with pegs 410 arranged on a roller 430. As shown, the roller 430 may have 5-petal flower wrap stamps 436, a 1-petal flower wrap stamp 456, a 4-petal flower wrap stamp 426, a 2-petal flower wrap stamp 446, and a 3-petal flower wrap stamp 416. In some other embodiments, different combinations of different flower wrap stamp designs are used. In some embodiments, the roller allows for a modular design that allows a user to remove and replace stamps. The roller 430 may be used manually or may be used in a mechanical device. In some embodiments, the stamps 400 are arrange to minimize the amount of excess waste material produced.

Figure 4D:
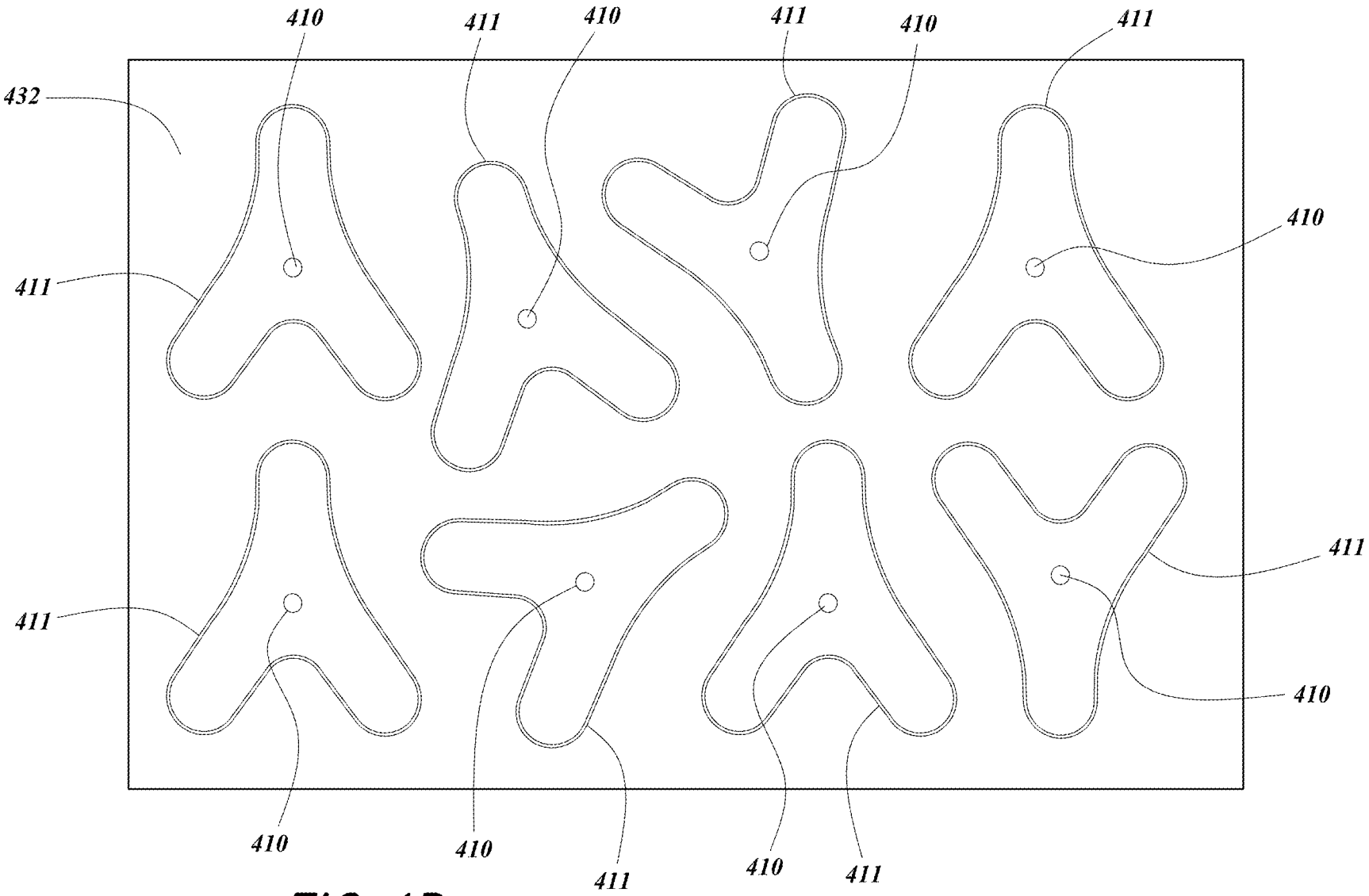

FIG. 4D depicts the foot 432 of a press arm with a plurality of stamps 411 with pegs 410 to create 3-petal flower wraps arranged in a pattern to reduce material waste. In some embodiments, the foot 432 is a detachable tray that attaches to the press arm. In some embodiments, the tray with the stamps 411 is used manually to create flower wraps. In some embodiments, other combinations of designs of flower wraps are used. In some embodiments, the foot 432 holds multiple stamps 411 such as 1 stamp, 2 stamps, 3 stamps, 4 stamps, 5 stamp, 6 stamps, 7 stamps, 8 stamps, 9 stamps, 10 stamps, and etc. In some embodiments, the foot 432 holds about, at least about, or no more than about between 1-100 stamps, between 1-1000 stamps, between 1-10,000 stamps, or any ranges incorporating any two of the aforementioned values. In some embodiments, the foot allows modular interchangeability of the stamps 411. In this example, the stamp 411 shows a 3-petal design. In some embodiments, a stamp 411 has a 1-petal design, 2-petal design, 3-petal design, 4-petal design, 5-petal design, 6-petal design, 7-petal design, 8-petal design, 9-petal design and etc. The stamp 411 can also have a 10 or less petals design, a 20 or less petals design, or other numbers of petals that may practically allow folding a faux flower. In some embodiments, the foot 432 includes stamps 411 having different numbers of petals. For example, the foot 432 may have one or more stamps 411 having five petals, one or more stamps 411 having four petals, and one or more stamps 411 having 3 petals. Any combination of petal counts may be used. The stamp 411 may be pressed into a stack of soap sheets to create a stack of flower wraps in the shape of the petal stamp 411.

Figure 4F:
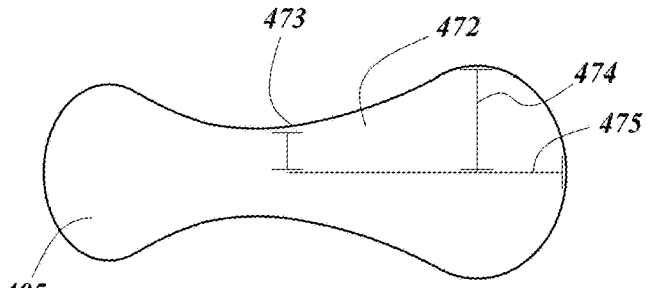
Figure 4I:
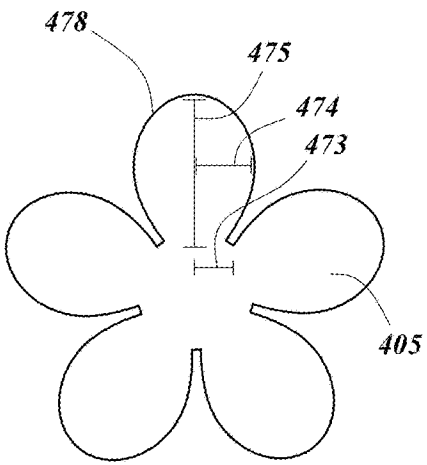
Figure 4E:
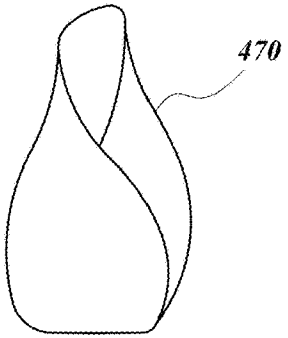
Figure 4E:
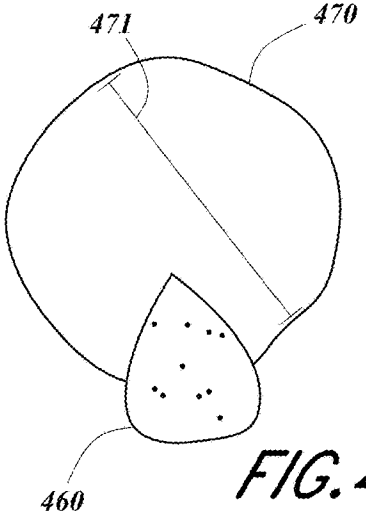
Figure 4H:
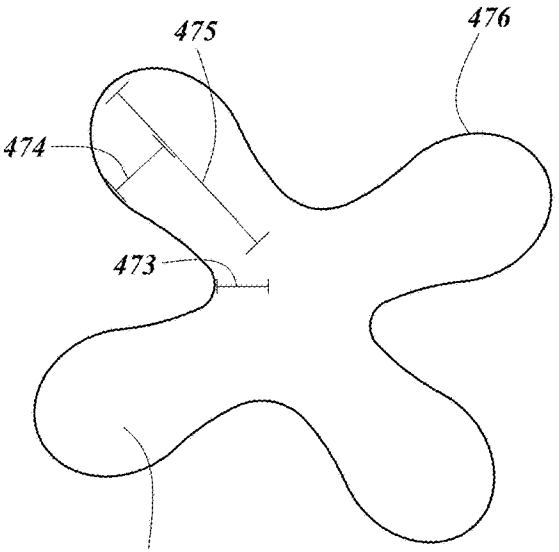
Figure 4G:
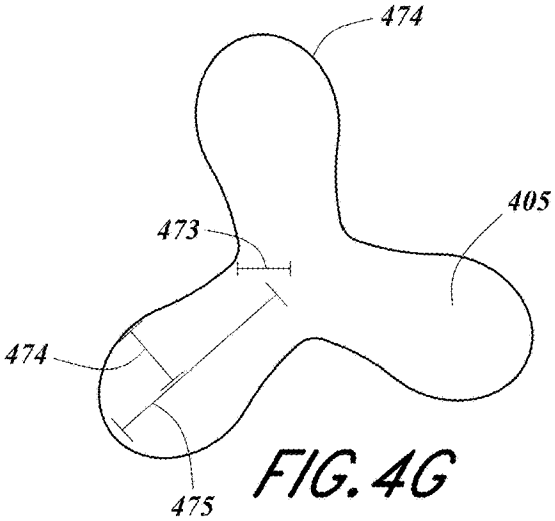

FIG. 4E-4H shows examples of a 1-petal 470, a 2-petal 472, a 3-petal 473, a 4-petal 476, and a 5-petal design 478. In some embodiments, there is about, at least about, or no more than about a 10 or less petals design, a 20 or less petals design, other numbers of petal designs, or any ranges incorporating any two of the aforementioned values. In FIG. 4E, the diameter 471 may be uniform. FIG. 4E also depicts how a flower wrap may be placed around a core 460. The core 460 may be any of a number of materials, including, but not limited to soap, styrofoam, plastic, cork, wood, balloons, etc. The core may advantageously provide structural support for the flower wraps. In some embodiments, as shown in FIGS. 4F-4I, the flower wraps may have more than one petal, e.g., 2 petals (as shown in FIG. 4F), 3 petals (as shown in FIG. 4G), 4 petals (as shown in FIG. 4H), or 5 petals (as shown in FIG. 4I). Flower wrappers having more than one petal may have a plurality of petal bodies 405 attached (e.g., integrally formed with) to a central hub by a petal neck. Each petal body 405 may have a petal length 475. The petal length 475 may be varied based on the type or size of flower being produced. In some embodiments, the petal body's petal length 475 is about 4 cm. In some embodiments, the petal length 475 is about, at least about, or no more than about 10 cm or less, 9 cm or less, 8 cm or less, 7 cm or less, 6 cm or less, 5 cm or less, 4 cm or less, 3 cm or less, 2 cm or less, 1 cm or less, or ranges including any two of the aforementioned values. The petal body 405 may have a width 474. In some embodiments, the petal width 474 is about, at least about, or no more than about 90% or less of the petal length 475, 80% or less of the petal length 475, 70% or less of the petal length 475, 60% or less of the petal length 475, 50% or less of the petal length 475, 40% or less of the petal length 475, 30% or less of the petal length 475, 20% or less of the petal length 475, 10% or less of the petal length 475, or any ranges incorporating any two of the aforementioned values. The petal neck may have a neck width 473. The petal neck width 473 may be about, at least about, or no more than about at least 5% of the petal length 475. In some embodiments, the petal neck width 473 is about, at least about, or no more than about 50% or less of the petal length 475, 40% or less of the petal length 475, 30% or less of the petal length 475, 20% or less of the petal length 475, 10% or less of the petal length 475, or any ranges incorporating any two of the aforementioned values. In some embodiments, the neck width 473 is thick enough to support the petal length 475 for petal 405 structural purposes and may be thick enough to provide flexibility of the petals 405.

Figure 5A:
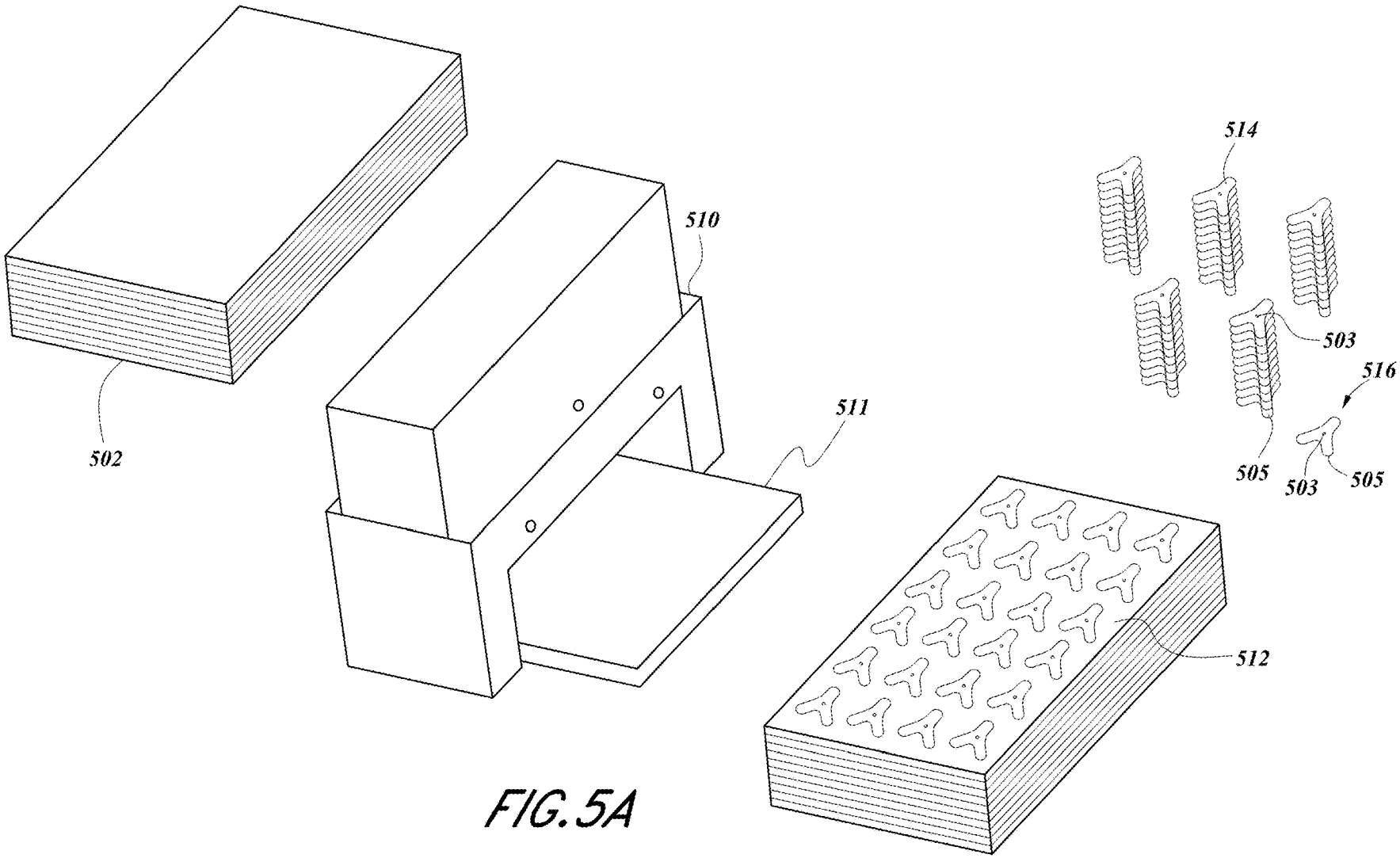
FIGS. 5A-5C depict systems for producing soap flower wraps from a stack of soap sheets.
Figure 5B:
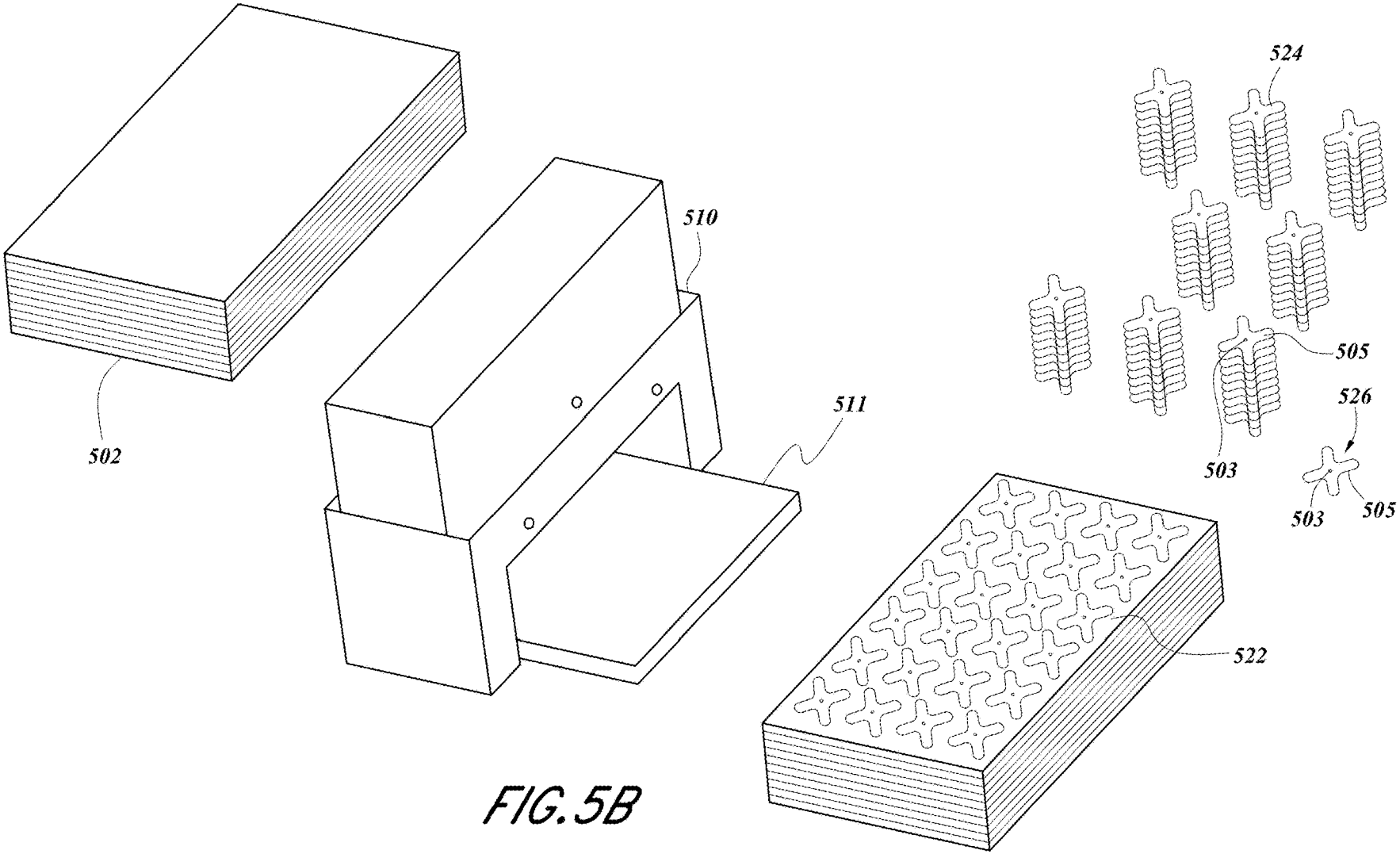
Figure 5C:
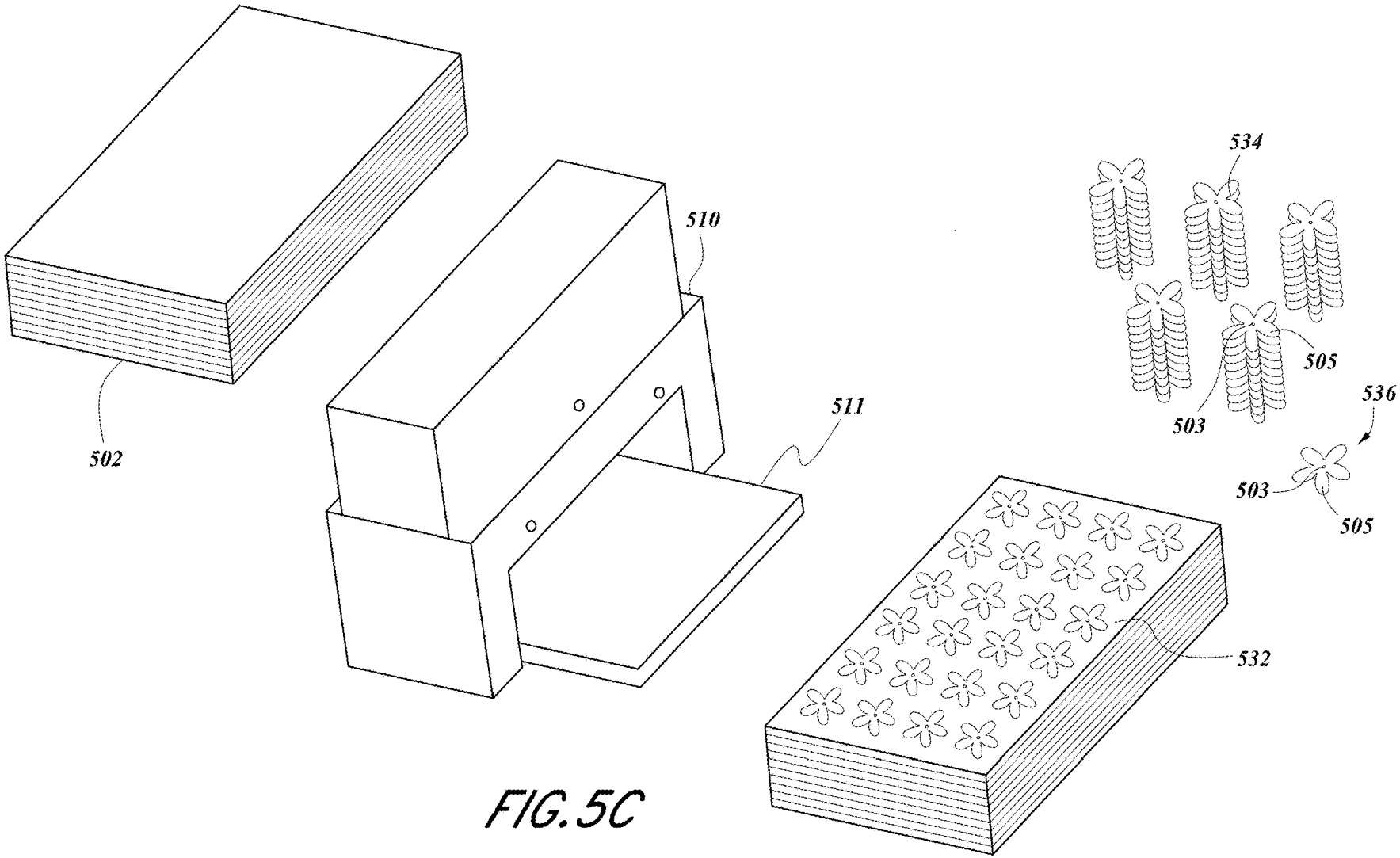

FIGS. 5A, 5B, and 5C show various embodiments of systems that may be used to produce flower wraps 516, 526, 536. Arranged sheets of material 502, e.g., stacks of thin, soap sheets, may be inserted into a device 510 with a stamping bed 511 that stamps out flower wrap designs 516, 216, 536.

A plurality of sheets 502 may be used. In some embodiments, about, at least about, or no more than about 1 sheet, 2 sheets, 3 sheets, 4 sheets, 5 sheets, 6 sheets, 7 sheets, 8 sheets, 9 sheets, 10 sheets, or more are used. In some embodiments, between about 1-100 sheets may be used, between about 10-80 sheets, between about 20-60 sheets, between about 30-40 sheets, between 1-1000 sheets may be used, between 1-10,000 sheets, or any other number of sheets that may practically be used in a manufacturing setting, or any ranges incorporating any two of the aforementioned values. In some embodiments, a sheet of material, e.g., a soap sheet, is about, at least about, or no more than about between about 0.1 mm-1 mm thick, between about 0.1 mm-5 mm thick, between about 0.1-10 mm thick, or any thickness that would allow practical use for flower wrapper folding/wrapping, or any ranges incorporating any two of the aforementioned values. In some embodiments, the soap sheets comprise pleated designs, ridges, perforations, visual markers, or other features to ensure proper and seamless stacking. The soap sheets may also have details stamped or embedded into the soap sheets prior to stamping flower wraps out of the sheets. These details can be flower or petal folds, flower or petal veins folds, veins, blemishes, creases, ridges, bumps, insects, creatures, textures, scents, paints, glitter, sheens, anti-sticking materials, or other types of features. In some embodiments, the sheets comprise chocolate, sugar, taffy, plastic-like substances, or any other pliable edible or non-edible material. In some embodiments, substances are applied to better increase the structure of the folded flower and/or to prevent drying (e.g., adhesives, water, oils, sealant, or other substances).

The designs 516, 526, 536 may have petals 505 with or without holes 503. In some embodiments, other plant shapes (e.g., leaves, anthers, filaments, stigmas, styles, ovaries, ovules, sepals, pistils, seeds, peduncles, leaves, branches, roots, shoots, seeds, spores, caps, tendrils, lobes, calyx, stems, or other features may be stamped out as well) or other shapes (e.g., animals, raindrops, logos, and words) are stamped out. In some embodiments, the device 510 uses a press arm with stamps as shown in FIG. 4D. In some embodiments, the device 510 uses a roller as shown in FIG. 4C. In some embodiments, the device 510 uses laser cutting or high-pressure water jets. The soap sheets 502 may have pleated designs, ridges, perforations, visual markers, or other markers to ensure proper and/or seamless stacking. The soap sheets may also have pleated designs, ridges, perforations, visual markers, or other markets to ensure proper and/or square alignment with the stamping device 510. In some embodiments, the device uses a conveyor belt where soap sheets 502 are fed into the device 510, and flower wraps 516, 526, 536 or columns of flower wraps 514, 524, 534 are produced. The used soap sheets with flower wraps stamped out of them 512, 522, 532 may be recycled, thrown away, used for subsequent stamping, or used to create other objects. The stamps may be arranged accordingly to reduce the amount of unused soap sheets. In some embodiments, the material left over in the used soap sheets with flower wraps stamped out of them 512, 522, 532 is about, at least about, or no more than about 90% or less of the amount of material used in unstamped sheet(s) 502, 80% or less of the amount of material used in unstamped sheet(s) 502, 70% or less of the amount of material used in unstamped sheet(s) 502, 60% or less of the amount of material used in unstamped sheet(s) 502, 50% or less of the amount of material used in unstamped sheet(s) 502, 40% or less of the amount of material used in unstamped sheet(s) 502, 30% or less of the amount of material used in unstamped sheet(s) 502, 20% or less of the amount of material used in unstamped sheet(s) 502, 10% or less of the amount of material used in unstamped sheet(s) 502, or any ranges incorporating any two of the aforementioned values. In some embodiments, the material left over in the used soap sheets with flower wraps stamped out of them 512, is more than about 1% of the amount of material used in unstamped sheet(s) 502, more than about 2% of the amount of material used in unstamped sheet(s) 502, more than about 3% of the amount of material used in unstamped sheet(s) 502, more than about 4% of the amount of material used in unstamped sheet(s) 502, more than about 5% of the amount of material used in unstamped sheet(s) 502, more than about 6% of the amount of material used in unstamped sheet(s) 502, more than about 7% of the amount of material used in unstamped sheet(s) 502, more than about 8% of the amount of material used in unstamped sheet(s) 502, more than about 9% of the amount of material used in unstamped sheet(s) 502. In some embodiments, the material left over in the used soap sheets with flower wraps stamped out of them 512 is about, at least about, or no more than about 10% or more of the amount of material used in unstamped sheet(s) 502, 20% or more of the amount of material used in unstamped sheet(s) 502, 30% or more of the amount of material used in unstamped sheet(s) 502, 40% or more of the amount of material used in unstamped sheet(s) 502, 50% or more of the amount of material used in unstamped sheet(s) 502, 60% or more of the amount of material used in unstamped sheet(s) 502, 70% or more of the amount of material used in unstamped sheet(s) 502, 80% or more of the amount of material used in unstamped sheet(s) 502, 90% or more of the amount of material used in unstamped sheet(s) 502, or ranges incorporating any two of the aforementioned values.

Flower wraps 516, 526, 536, may have petals 405 and/or holes 403. For example, as shown in FIG. 5A, 3-petal flower wraps may be made and used. FIG. 5A shows a column of 3-petal design flower wraps 514 that may be taken out of or stamped out of the stacked soap sheets 512. A representative single 3-petal soap flower 516 is also shown. As shown in FIG. 5B, 4-petal flower wraps may be made and used. FIG. 5B shows an example of a column of 4-petal design flower wraps 524 may be taken out of or stamped out of a stacked soap sheets sheet 522. A representative single 4-petal soap flower 526 is also shown. As shown in FIG. 5C, a column of 5-petal flower wraps may be made. A column of 5-petal flower wraps 534 is shown in FIG. 5C. The 5-petal design 534 may be taken out of or stamped out of stacked soap sheets sheet 532. A representative single 5-petal soap flower 536 is also shown.

In some embodiments, flower wraps with 1 petal are made. In some embodiment, flower wraps with a plurality of petals may be made such as about, at least about, or no more than about 2 petals, 3 petals, 4 petals, 5 petals, 6 petals, 7 petals, 8 petals, 9 petals, etc. In some embodiments, about, at least about, or no more than about 10 petals or less, 20 petals of less, 50 petals or less, 100 petals or less, 200 petals or less, 500 petals or less, or other designs with different numbers of petals are made, or ranges including any two of the aforementioned values.

The flower wraps may be made by cutting one or more sheets of soap at a time, e.g., sheets of soap may be stacked (with or without a non-stick layer in-between) then cut. The device 510 may be a stamping device that uses a flower petal stamp.

The device 510 may also allow interchangeability of different types of flower petal stamps. The device 510 may also use laser cutting. The device 510 may also use high-pressure water cutting. The device 510 may use a physical cutting mechanism such as a saw, band-saw, or guillotine blade. In some embodiments, different kinds of stamps are used interchangeably in the stamping mechanism. For instance, a 2-petal stamps may be swapped out with a 3-petal stamp, a 4-petal stamp, or in other types of stamps, including other types of non-flower wrap stamps. In some embodiments, different kinds of stamps are used at the same in the stamping mechanism. For example, a 2-petal stamp may be used alongside a 3-petal stamp, a 4-petal stamp, or in other numerous combinations.

Figure 6A:
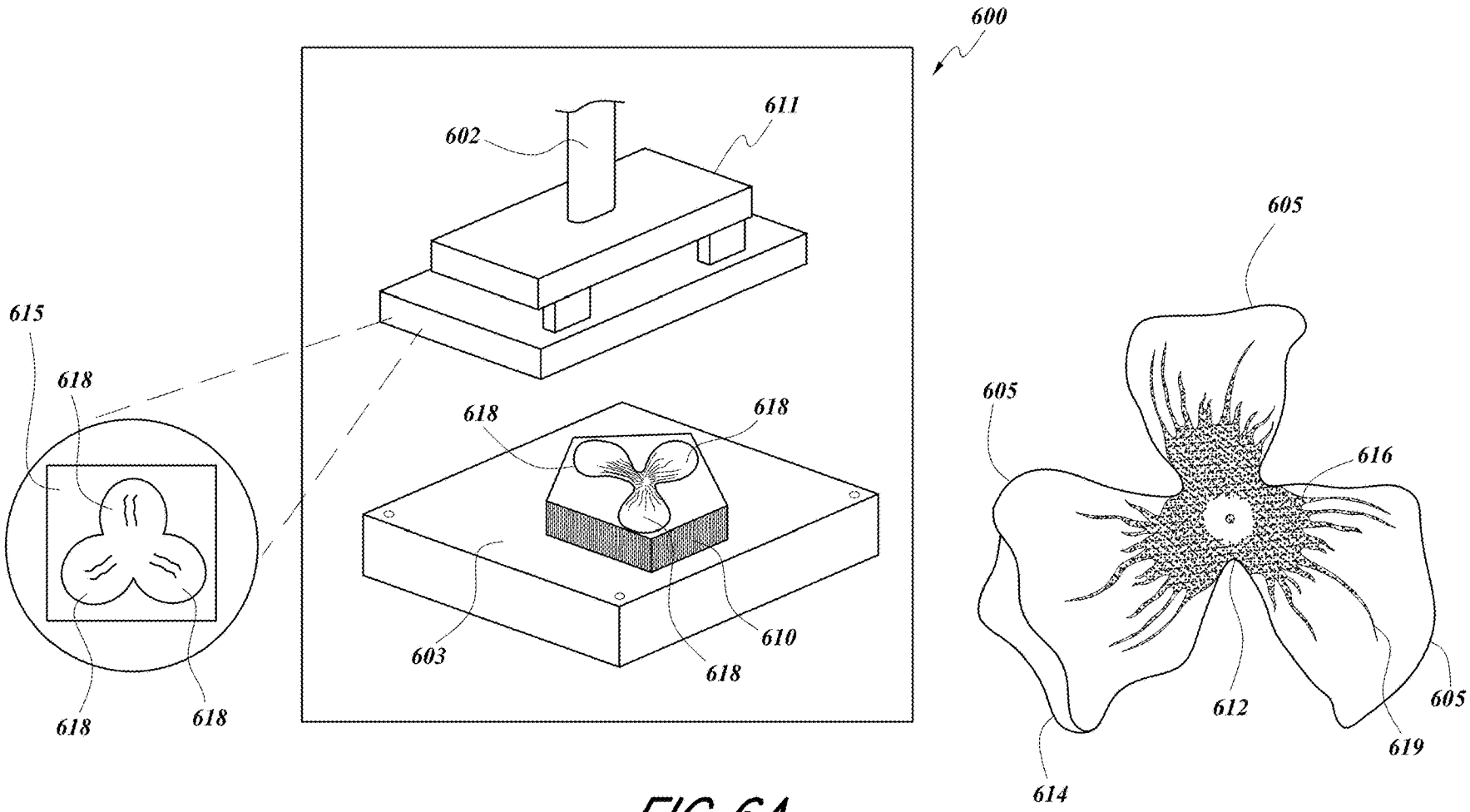
FIGS. 6A-6C depict systems for producing petal details on flower wraps.
Figure 6B:
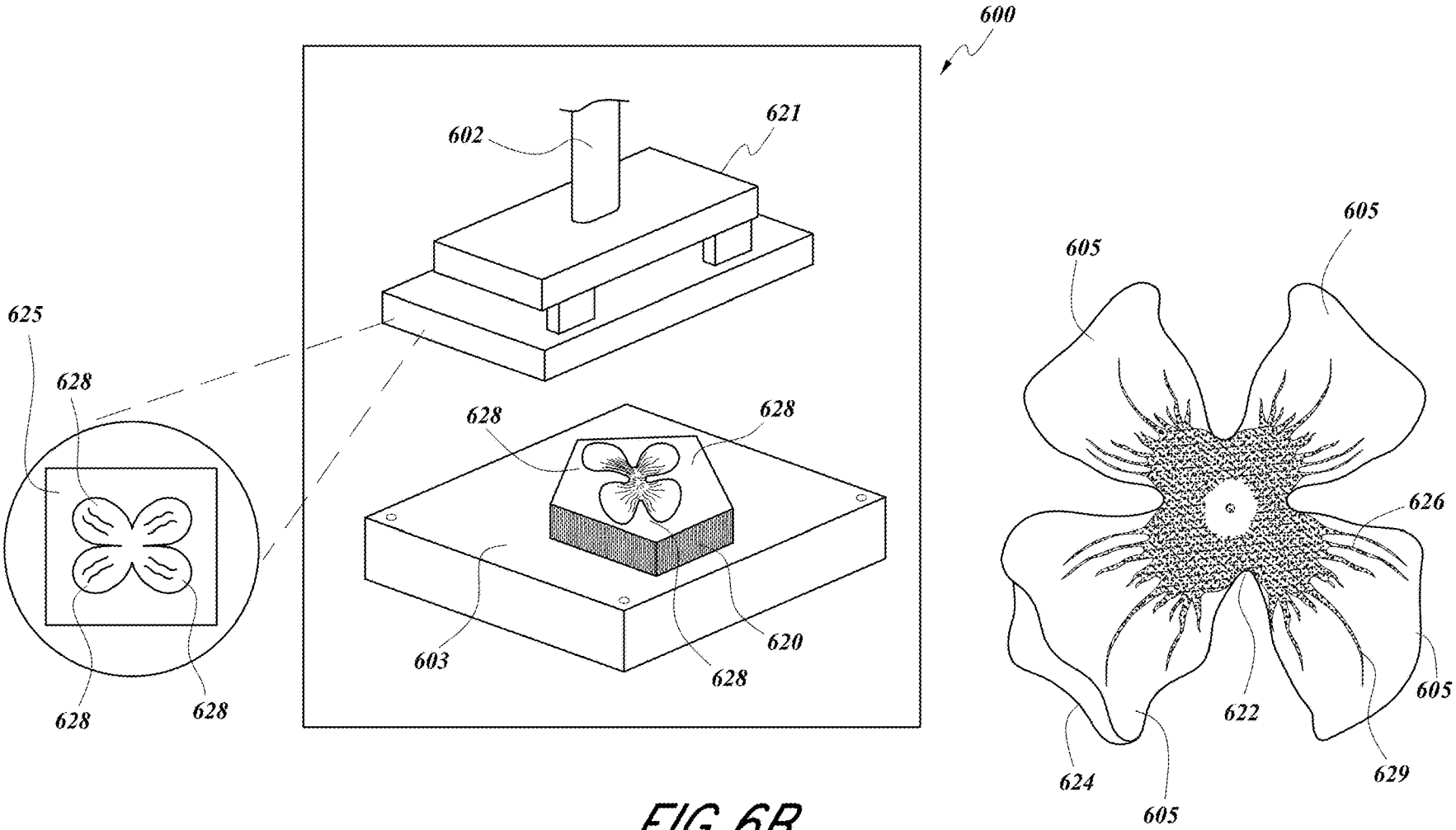
Figure 6C:
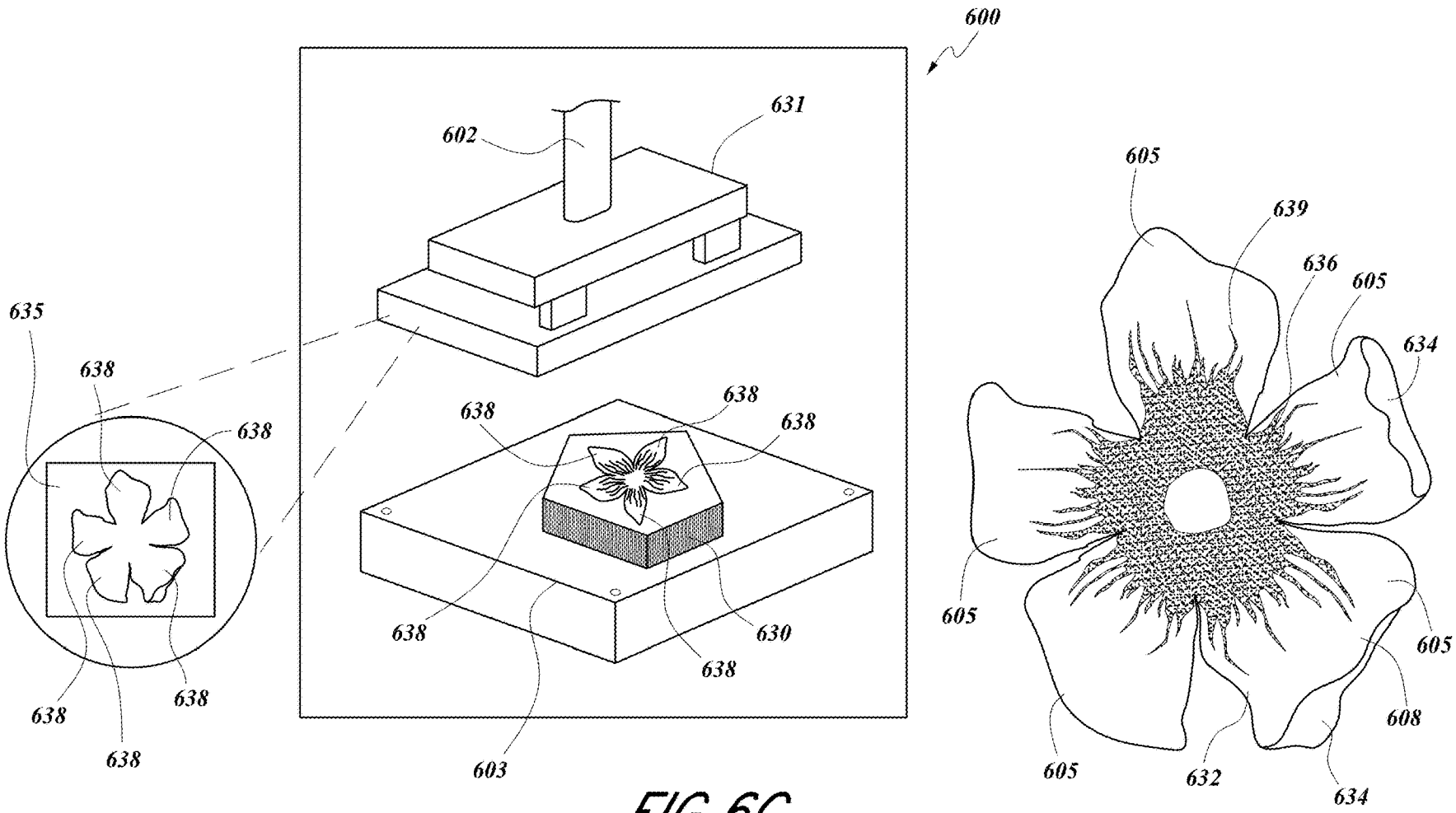

FIGS. 6A-6C illustrate an example detail embedding stamp device 600. In some embodiments, the device 600 has a bottom support platform 603. The detail embedding device 600 may have two parts, an upper portion 611, 621, 631 that may add petal detail 618, 628, 638 (e.g., folds 614, 624, 634, veins 619, 629, 639, blemishes 616, 626, 636) to the top surface of the petals 605 of the flower wrapper 612, 622, 632, and a lower portion 610, 620, 630 that may add petal detail 618, 628, 638 (e.g., folds 614, 624, 634, veins 619, 629, 639, blemishes 616, 626, 636) to the lower surface of the petals 605 of the flower wrapper 612, 622, 632.

Additional details that detail embedding device 600 may embed may include, but are not limited to, folds, veins, blemishes, insects, creatures, creases, ridges, bumps, texture, or other types of features embedded into or onto the flower wraps 106. Plant or fungus parts, such as, but not limited to, anthers, filaments, stigmas, styles, ovaries, ovules, sepals, pistils, seeds, peduncles, leaves, branches, roots, shoots, seeds, spores, caps, tendrils, lobes, calyx, or stems may also be embedded. Flower details may be embedded with a mechanical press. In some embodiments, flower details are embedded manually. Flower details may be embedded with chemical etching. In some embodiments, flowers are embedded with a mold. In some embodiments, flower details are embedded with a stencil. In some embodiments, flower details are embedded with an embedding method. In some embodiments, fungus shaped wraps (e.g., mushroom caps, mushroom stems) are made.

Some embodiments of the upper portion stamp 615, 625, 635 that have example petal features 618, 628, 638 are shown in FIGS. 6A-6C. Some embodiments of the lower portion stamp 610, 620, 630 that have example petal features in 618, 628, 638 are shown in FIGS. 6A-6C. In some embodiments, the upper stamp 615, 625, 635 and the lower stamp 610, 620, 630 are made out of metal, plastic, wood, or stone. A press machine arm 602 may stamp flower petal detail patterns into the flower wraps discussed above. FIG. 6A shows an exemplary, shaped flower wrap having only three petals 612 made using the stamp machine 600. FIG. 6B shows an exemplary, shaped flower wrap having only four petals 622 made using the stamp machine 600. FIG. 6C shows an exemplary, shaped flower wrap having five petals 632 made using the stamp machine 600. A flower wrap 612, 622, 632 may be placed into a flower petal stamp 600. The machine arm 602 may press down to drive the upper portion of the stamp 611, 621, 631 into the flower wrap 612, 622, 632 and closer to the lower portion of the stamp 610, 620, 630. As the upper portion 611, 621, 631 and the lower portion 610, 620, 630 of the stamp near each other, pressure may be applied to the flower wrap 612, 622, 632, thereby imprinting the pattern of the stamp onto the flower wrap 612, 622, 632. Although FIGS. 6A-6C show only a three, four, and five petal design stamp, a petal stamp 600 may have a design with fewer or more petals. In other examples, the petal stamp machine may use a roller element, where the roller element has flower petal design stamps. The roller may roll over flower wraps to imprint the designs on the flower wraps. In some embodiments, the stamp device has an upper portion 611, 621, 631 or only a lower portion 610, 620, 630. The press or rollers may be hydraulically, electrically, or manually powered.

Figure 7A:
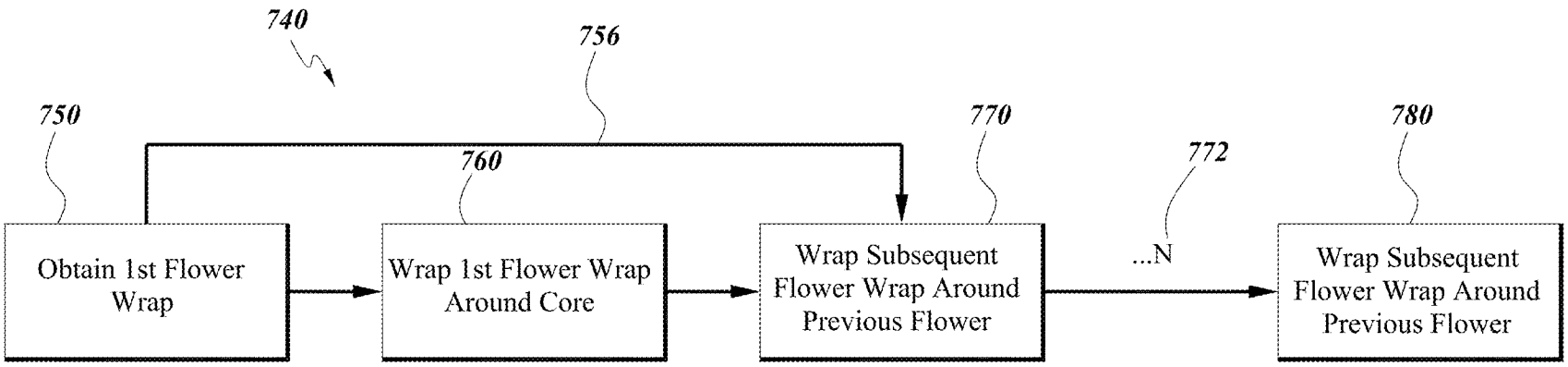
FIG. 7A shows a flowchart of a method for applying flower wraps to produce a soap flower.

FIG. 7A shows a flow chart 740 of a method for making artificial flower constructs out of flower wraps as disclosed herein. In step one 750, a first flower wrap can be obtained. In step two 760, the first flower wrap can be wrapped around a core. An adhesive can be used to aid wrapping the flower wrap around the core. In step three 770, a subsequent flower wrap may be wrapped around the previous construct. An adhesive can be used to aid wrapping flower wraps. Alternatively, in some embodiments, step three 770 can occur after step one 750 as shown by alternate path 756. Alternate path 756 shows that an example artificial flower can lack a core. In some embodiments, the artificial flower has a core. In some embodiments, the soap flower does not have a core. Subsequent steps 772 can be taken between step three 770 and the final step 780. The user can alter the size of the artificial flower by using more or fewer flower wraps. In some embodiments, about, at least about, or no more than about 2 layers are used, 3 layers are used, 4 layers are used, 5 layers are used, 6 layers are used, 7 layers are used, 8 layers are used, 9 layers are used, 10 layers are used, or etc., or any ranges incorporating any two of the aforementioned values. In some embodiments, about, at least about, or no more than about 10 layers or less are used, 20 layers or less are used, or etc., or any ranges incorporating any two of the aforementioned values. In some embodiments, about, at least about, or no more than about between 1-10 layers are used, between 2-15 layers are used, between 3-20 layers are used, between 4-25 layers are used, between 10-30 layers are used, or ranges including any two of the aforementioned values. A user can use different types of flower wraps designs to alter the look or type of flower made. In some embodiments, different combinations of flower wrappers with different number of petals are used. A user can of wrap as many flower wraps around the previous construct to reach the final step 780.

In some embodiments, the user can introduce flower wrap details between each step. These details can be folds, veins, blemishes, creases, ridges, bumps, insects, texture, scents, paint, glitter, sheen, anti-sticking material, or other types of features embedded to the flower wraps. In some embodiments, substances are applied to the flower wrap between each step to better increase the structure of the folded flower and/or to prevent drying (e.g., adhesives, water, oils, sealant, or other substances). In some embodiments, optional faux flower accessories can be added between each subsequent step such as, but not limited to, anthers, filaments, stigmas, styles, ovaries, ovules, sepals, pistils, seeds, peduncles, leaves, branches, roots, shoots, seeds, spores, caps, tendrils, lobes, calyx, stems, or other features are added. Other decorative objects may be added between each step. Objects include, but are not limited to, organisms (e.g., insects, birds, lizards, mammals, amphibians, bacteria, mold, invertebrates). In some embodiments, objects are faux dew. Textures can also be added to the flower wrap between each subsequent step.

In some embodiments, the artificial flower can be obtained or considered completed after step two 760, step three 770, step four, step five, step six, step seven, step eight, step nine, step ten, and etc.

Figure 7B:
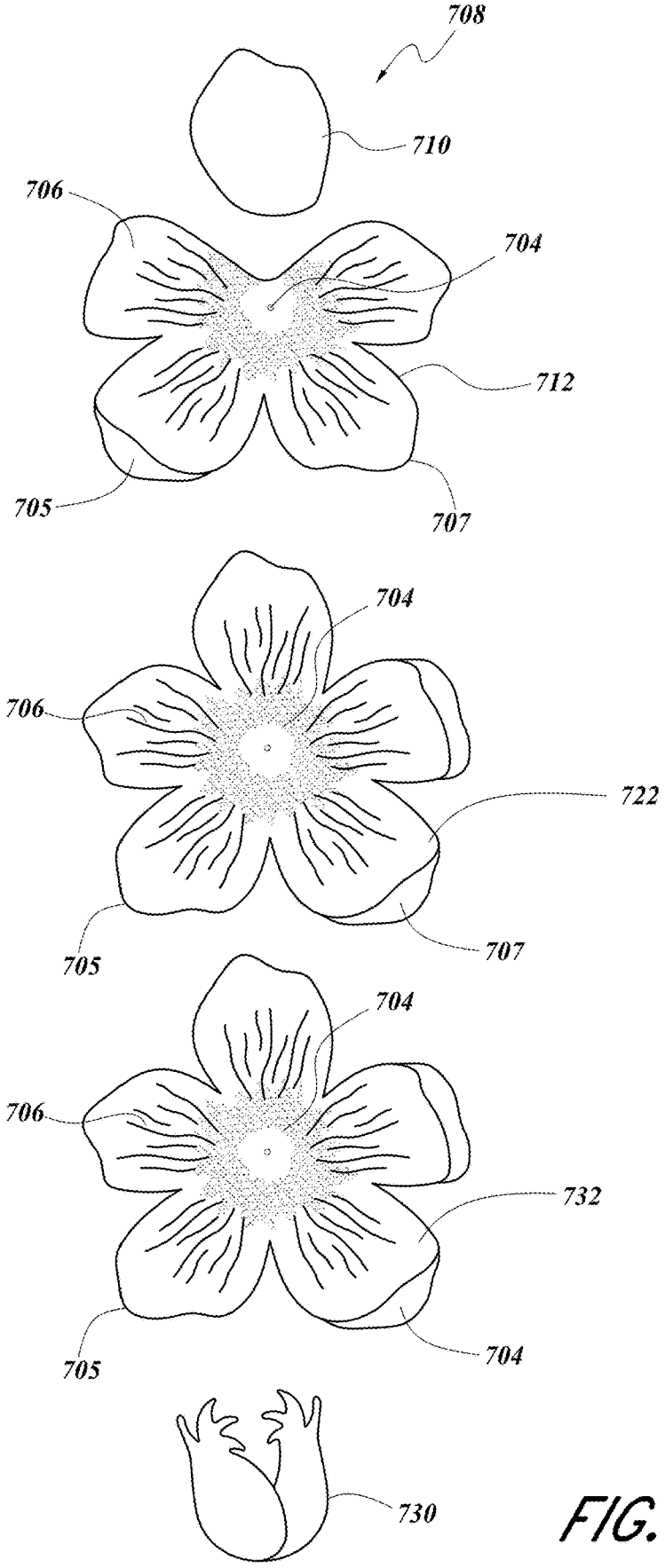
FIGS. 7B-7E depict the various portions of an example 3-layer folded soap flower and various steps in an exemplary method for producing the 3-layer folded soap flower.

FIG. 7B illustrates an exploded view of a 3-layer artificial flower 708 as disclosed herein. In some embodiments, a 4-petal flower wrapper 712 is the layer nearest to the core 710. A 5-layer flower wrap 722 can then be wrapped one layer outside. A subsequent 5-layer flower wrap 732 can be wrapped outside the previous layer. The flower wraps 712, 722, 732 can have petals 705 with folds 707. The petals 705 can have veins 706. The flower wraps 712, 722, and 732 can have holes 704. A calyx 730 can then be used to hold the flower construct.

Figure 7C:
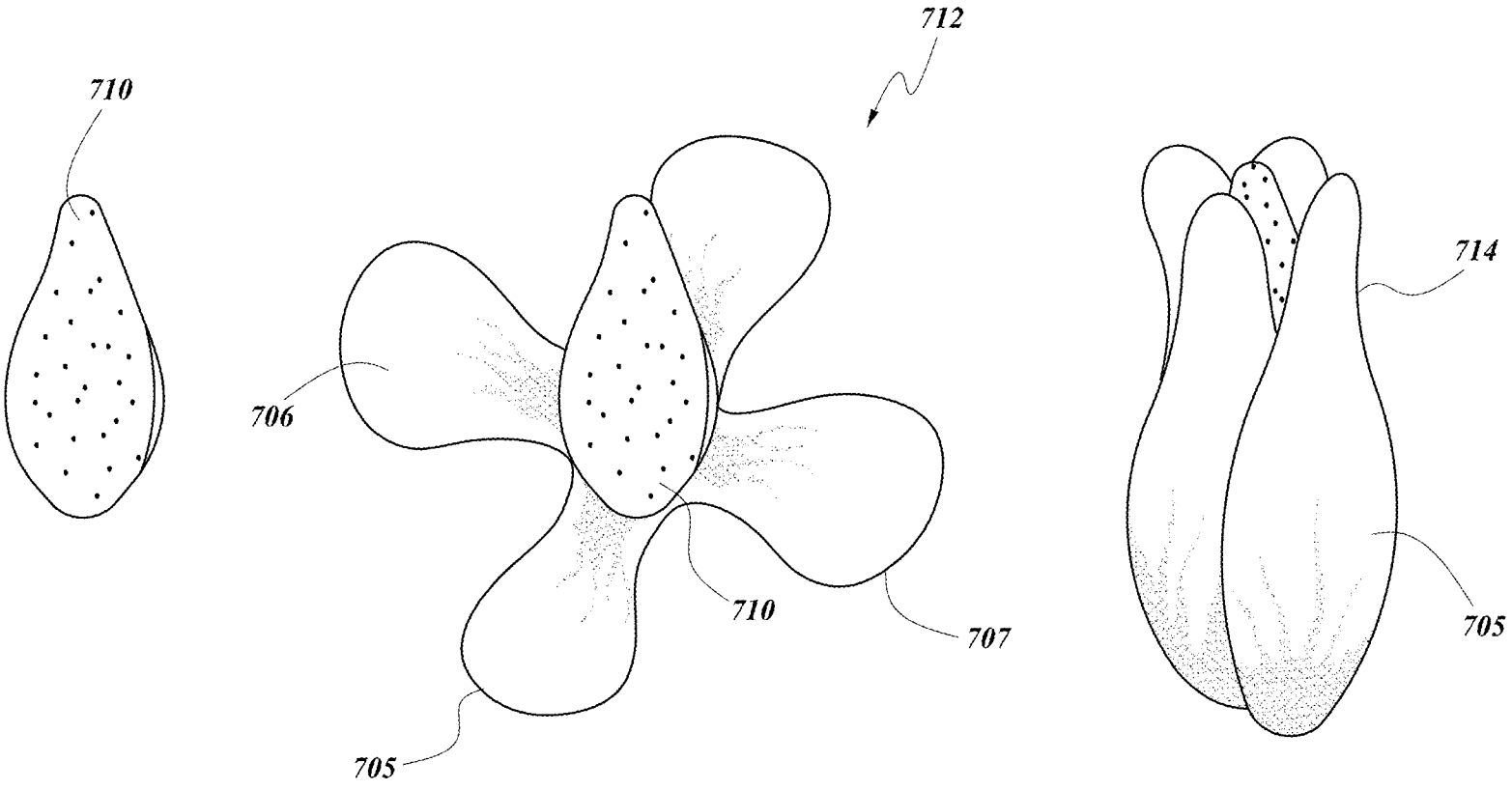
Figure 7D:
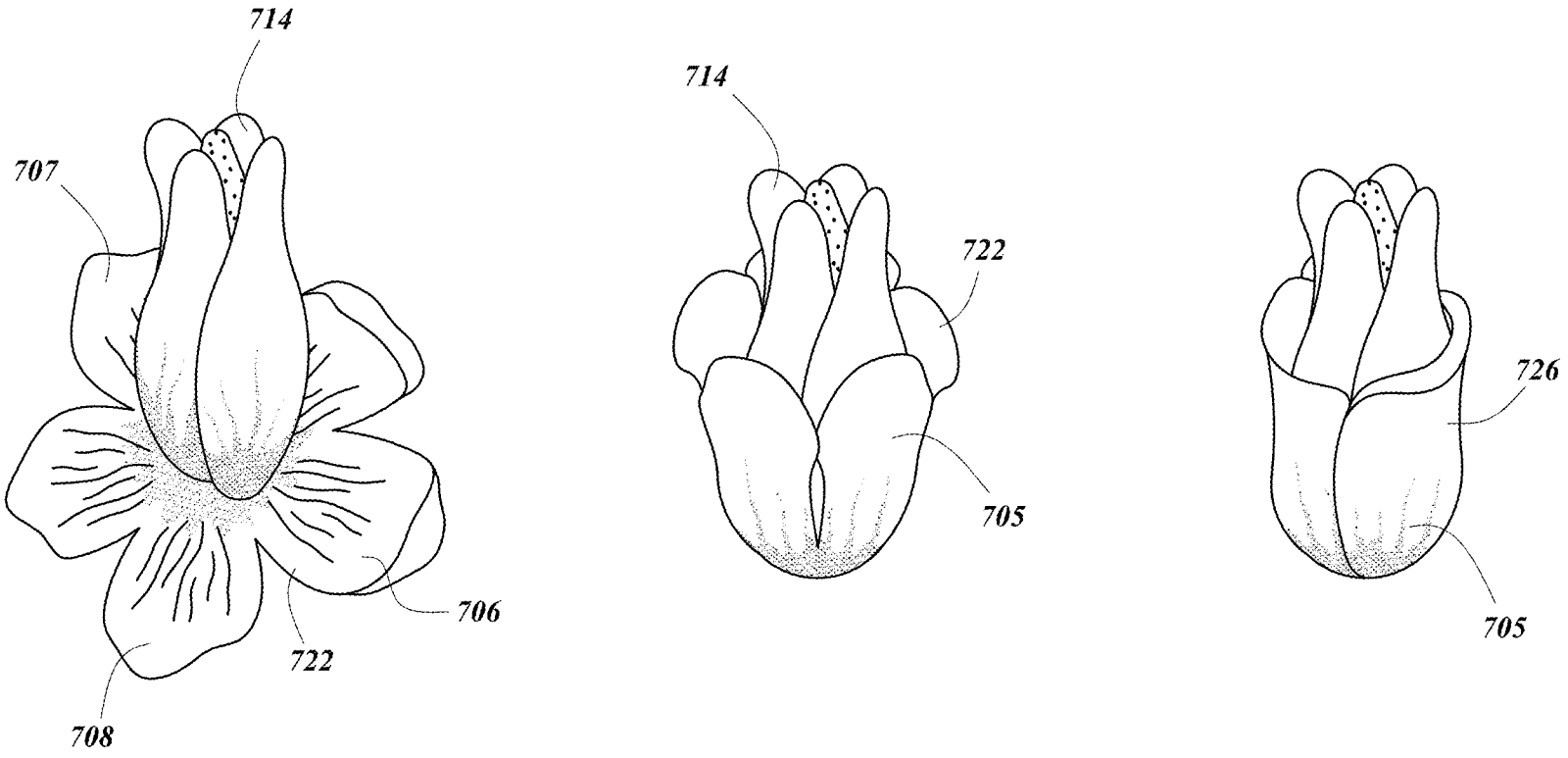
Figure 7E:
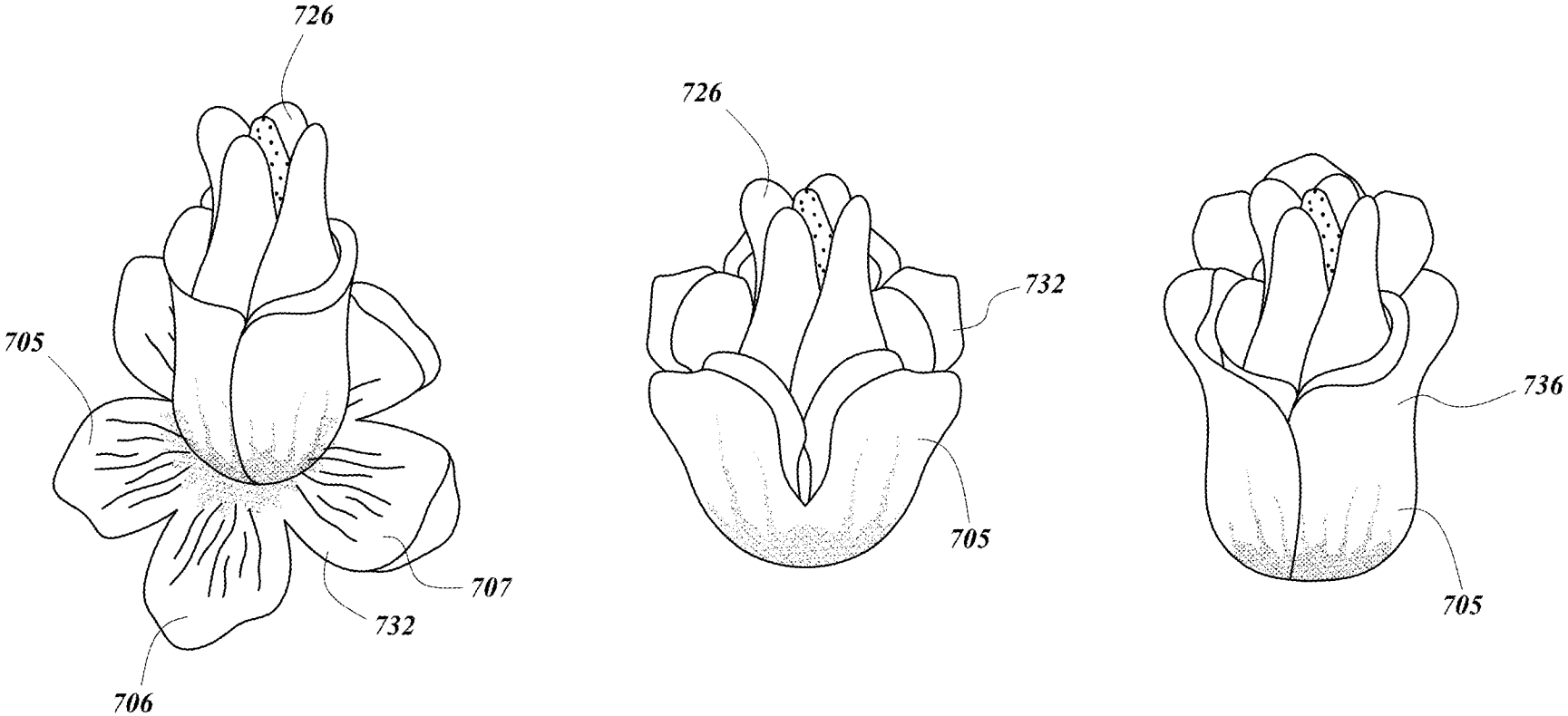

FIGS. 7C-7E show how example flower wraps as disclosed herein can be folded or wrapped to produce an artificial flower. The flower wrappers can have each petal 705 folded separately or all petals 705 folded simultaneously. In some embodiments, the flower wrappers as disclosed herein may be folded/wrapped to allow features such as veins 706 or folds 707, or other details disclosed herein to be hidden or revealed. A first flower wrapper layer 712 may be wrapped around a core 710. The flower folding may end at this step to produce a flower bud-like design 714. As shown in FIG. 7D, a second flower wrapper layer 722 may then be sequentially wrapped around the bud 714 to make a two-layer flower 726. The flower folding process may end here, e.g., after adding the second flower wrapper layer 722. As shown in FIG. 7E, a third wrapper layer 732 may then be sequentially wrapped around the two-layer flower 726, to make a three-layer flower 736. The flower folding process may end here, e.g., after adding the third flower wrapper layer 732. In some embodiments, an alternative method for warping the layers comprises of wrapping all the layers over the core at once instead of wrapping the core layer by layer.

Figure 8A:
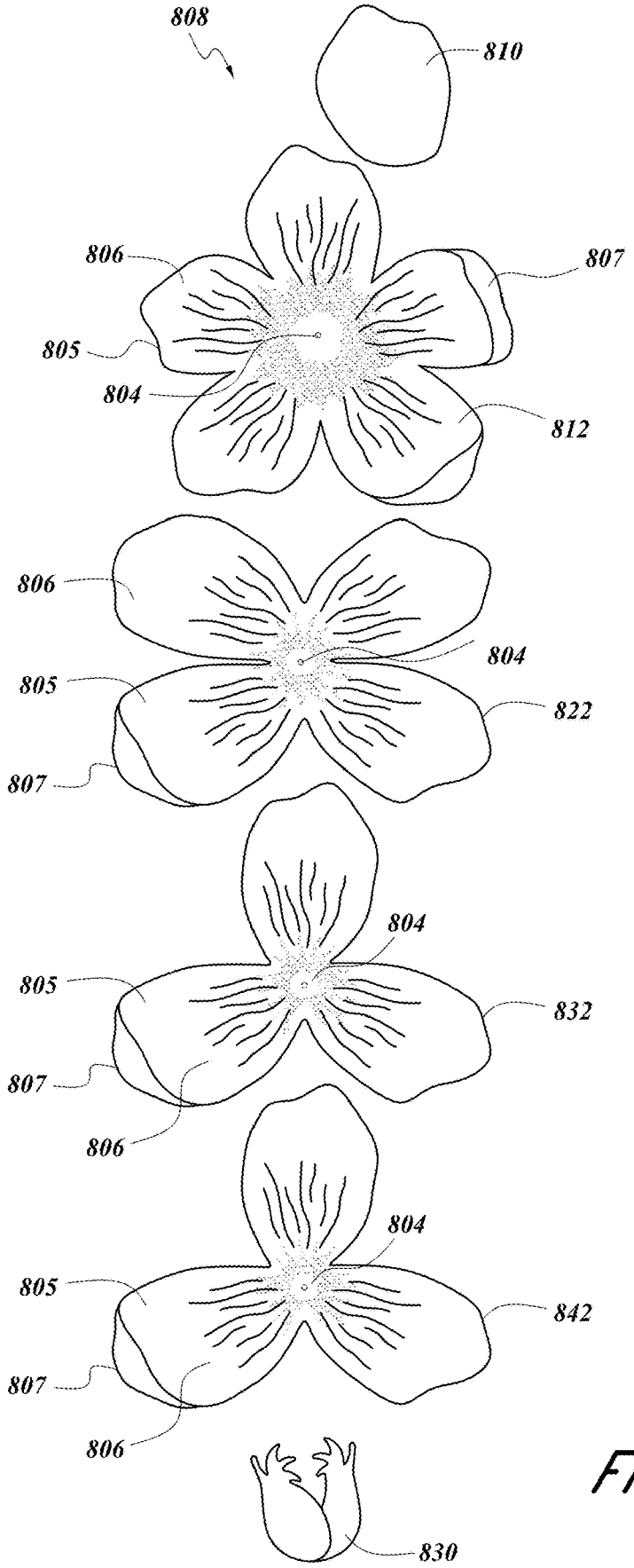
FIGS. 8A-8E depict the various portions of an example 4-layer folded soap flower and various steps in an exemplary method for producing the 4-layer folded soap flower.

FIG. 8A illustrates an exploded view of a 4-layer artificial flower 808 as disclosed herein. In some embodiments, a 5-petal flower wrapper 812 is the layer nearest to the core 810. But, depending on the type or look of the flower desired, the innermost flower wrapper may have any number of petals (e.g., 1 petal, 2 petals, 3 petals, 4 petals, 5 petals, 6 petals, 7 petals, 8 petals, 9 petals, etc.). A 4-layer flower wrap 822 can then be wrapped one layer outside. A subsequent 3-layer flower wrap 832 can be wrapped outside the previous layer. Another subsequent 3-layer flower wrap 842 can be wrapped outside the previous layer. Depending on the type or look of the flower desired, each subsequent flower wrapper may have any number of petals (e.g., 1 petal, 2 petals, 3 petals, 4 petals, 5 petals, 6 petals, 7 petals, 8 petals, 9 petals, etc.). The flower wraps 812, 822, 832, 842 can have petals 805 with folds 807. The petals 805 can have veins 806. The flower wraps 812, 822, 832, 842 can have holes 804. A calyx 830 can then then be used to hold the flower construct.

Figure 8B:
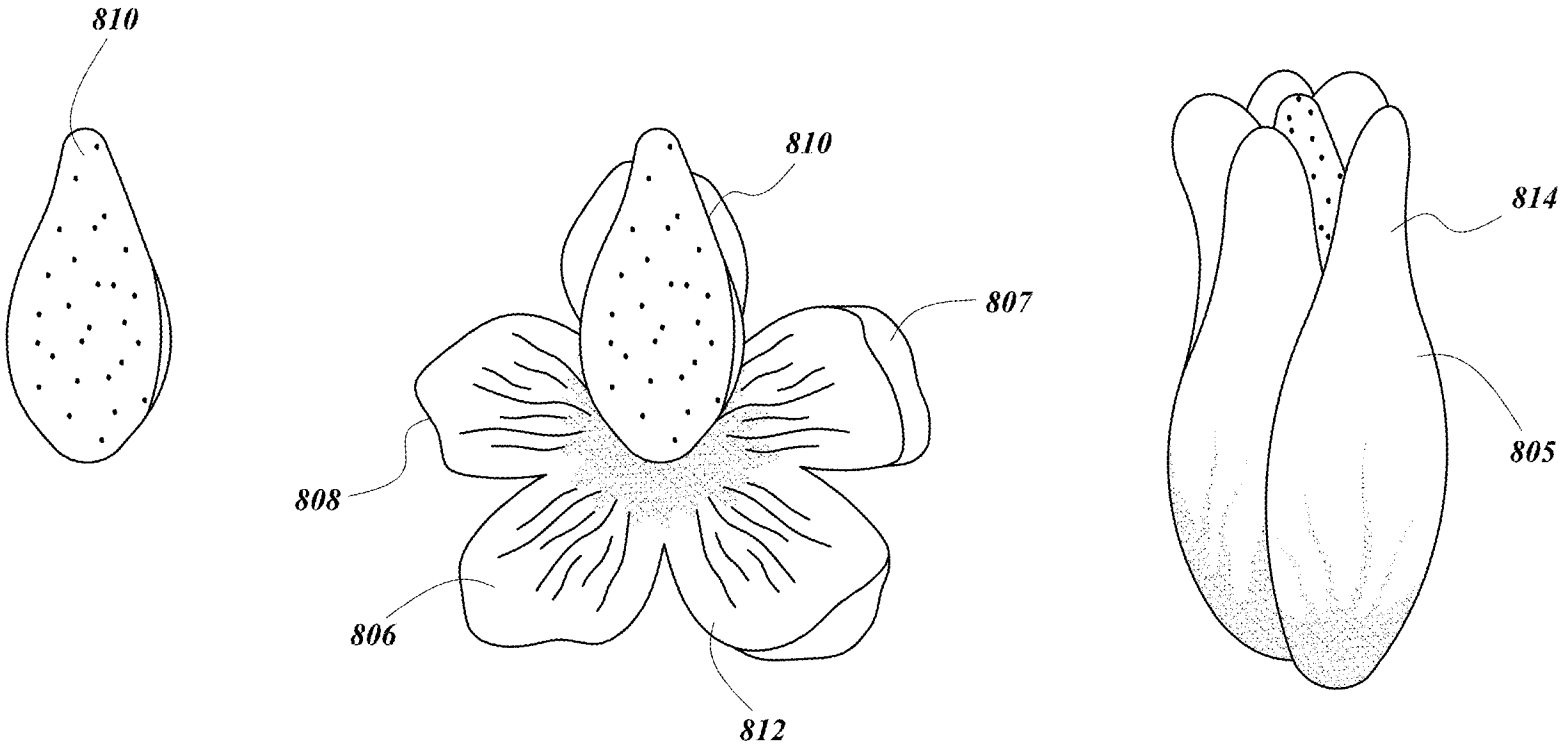
Figure 8C:
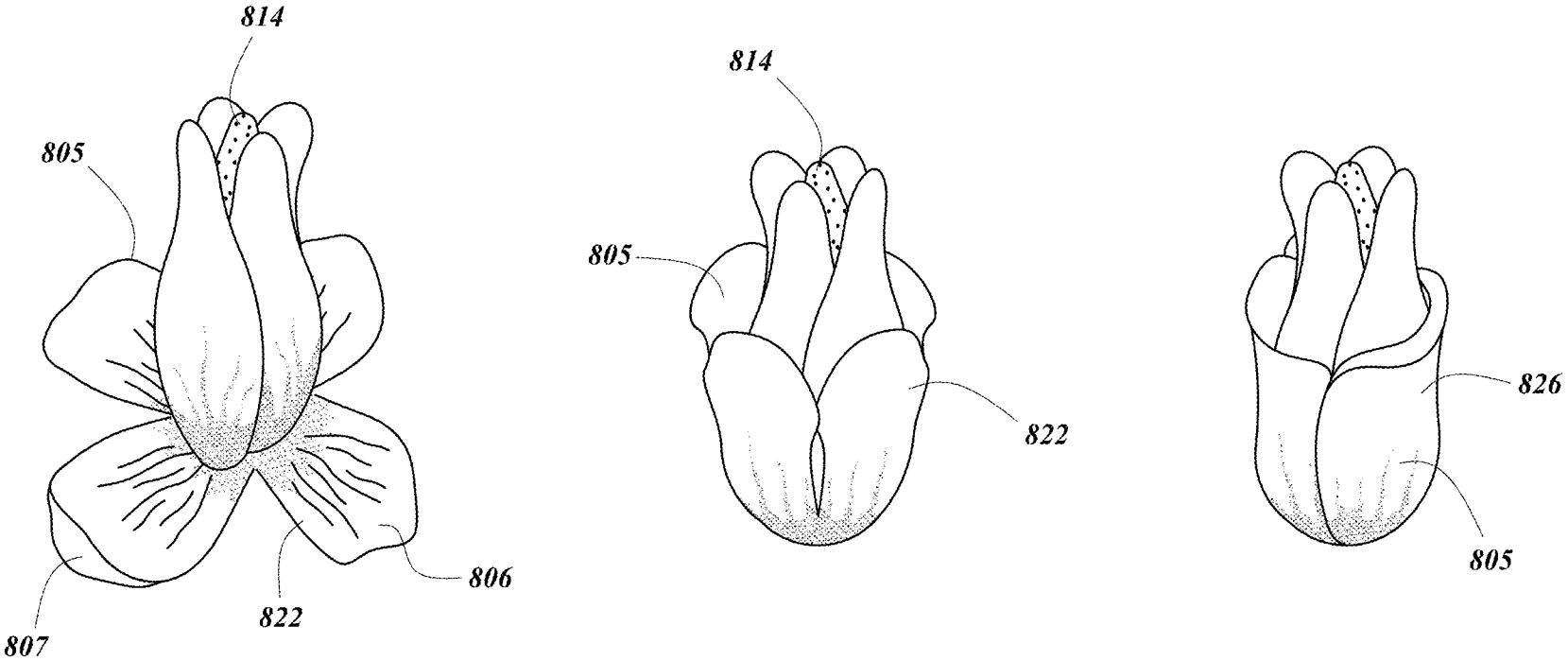
Figure 8D:
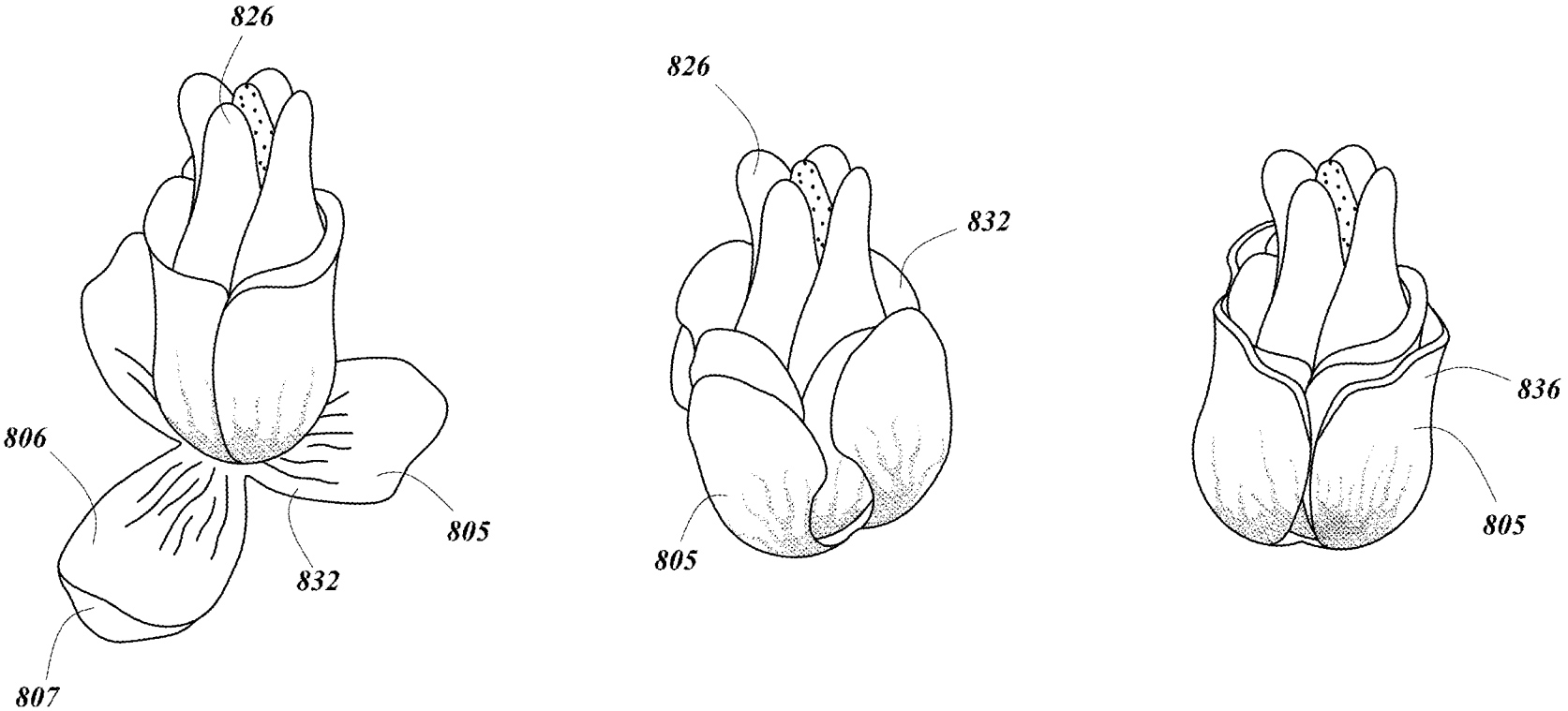
Figure 8E:
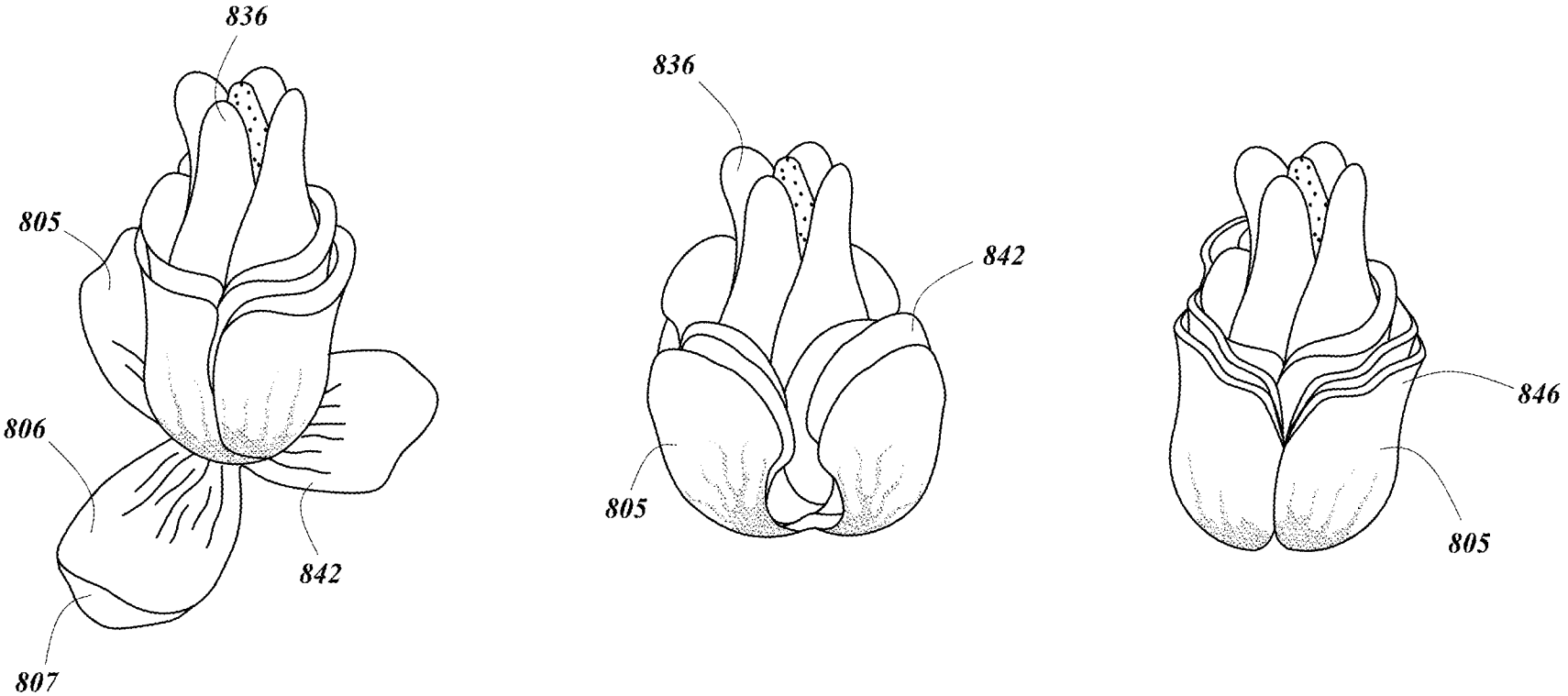
Figure 8F:
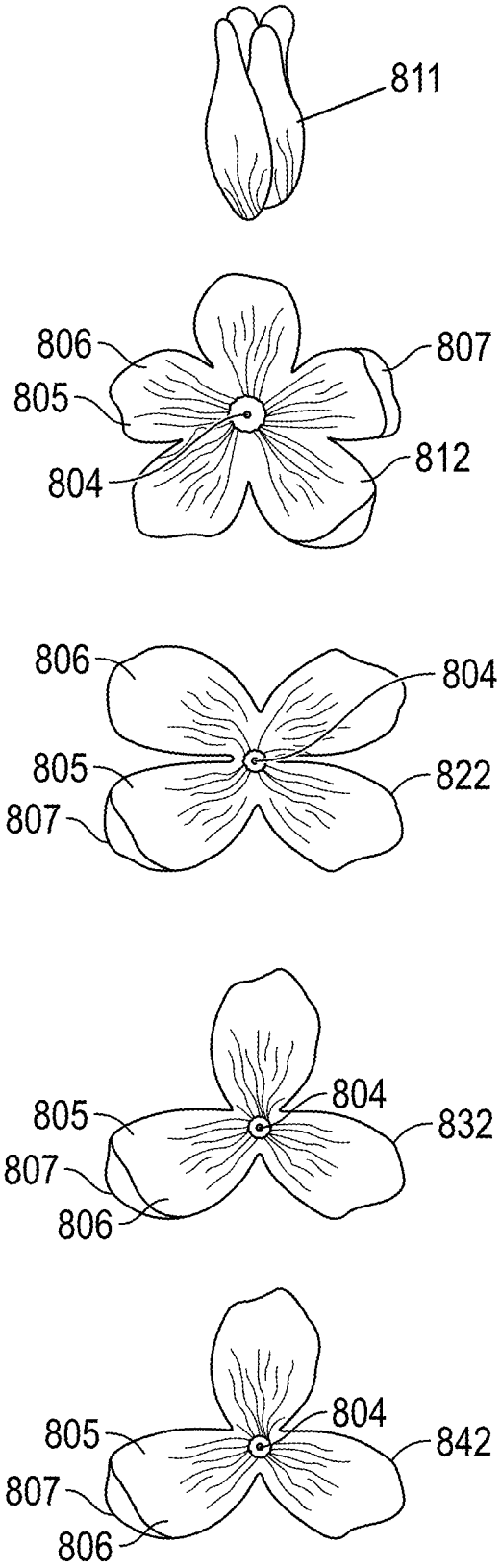
FIG. 8F shows an example artificial flower with a coreless design.

FIGS. 8B-8E show how example flower wraps as disclosed herein can be folded to produce an artificial flower. The flower wrappers can have each petal 805 folded separately or all petals 805 folded simultaneously. In some embodiments, the flower wrappers as disclosed herein may be folded/wrapped to allow features such as veins 806 or folds 807, or other details disclosed herein, to be hidden or revealed. As shown in FIG. 8B, a first flower wrapper layer 812 may be wrapped around a core 810. The flower folding may end at this step to produce a flower bud-like design 814. As shown in FIG. 8C, a second flower wrapper layer 822 may then be sequentially wrapped around the bud 814 to make a two-layer flower 826. The flower folding process may end here, e.g., after adding the second flower wrapper layer 822. As shown in FIG. 8D, a third flower wrapper layer 832 may then be sequentially wrapped around the two-layer flower 826, to make a three-layer flower 836. The flower folding process may end here, e.g., after adding the second flower wrapper layer 832. As shown in FIG. 8E, a fourth wrapper layer 842 may then be sequentially wrapped around the three-layer flower 836, to make a four-layer flower 846. The flower folding process may end here, e.g., after adding the second flower wrapper layer 842. In some embodiments, an alternative method for wrapping the layers comprises wrapping all the layers over the core at once instead of wrapping the core layer by layer. FIG. 8F shows an embodiment where no core is used or present. An artificial flower construct or a coreless flower 811 can be made by wrapping the petals of a flower wrap around each other with or without adhesives. A coreless flower 811 can be made by pinching the tips of the flower wrap petals together. The coreless flower 811 can also be used as the center structure for an artificial flower with multiple layers of flower wraps. In some embodiments, a 5-petal flower wrapper 812 is the layer nearest to the coreless inner flower 811. But, depending on the type or look of the flower desired, the innermost flower wrapper may have any number of petals (e.g., 1 petal, 2 petals, 3 petals, 4 petals, 5 petals, 6 petals, 7 petals, 8 petals, 9 petals, etc.). A 4-layer flower wrap 822 can then be wrapped one layer outside. A subsequent 3-layer flower wrap 832 can be wrapped outside the previous layer. Another subsequent 3-layer flower wrap 842 can be wrapped outside the previous layer. Depending on the type or look of the flower desired, each subsequent flower wrapper may have any number of petals (e.g., 1 petal, 2 petals, 3 petals, 4 petals, 5 petals, 6 petals, 7 petals, 8 petals, 9 petals, etc.). The flower wraps 812, 822, 832, 842 can have petals 805 with folds 807. In some embodiments, a coreless artificial flower construct can have 1 layer, 2 layers, 3 layers, 4 layers, 5 layers, 6 layers, 7 layers, 8 layers, 9 layers, etc.) The petals 805 can have veins 806. The flower wraps 812, 822, 832, 842 can have holes 804. A calyx can then then be used to hold the flower construct. In some embodiments, a calyx is not used.

Figure 9A:
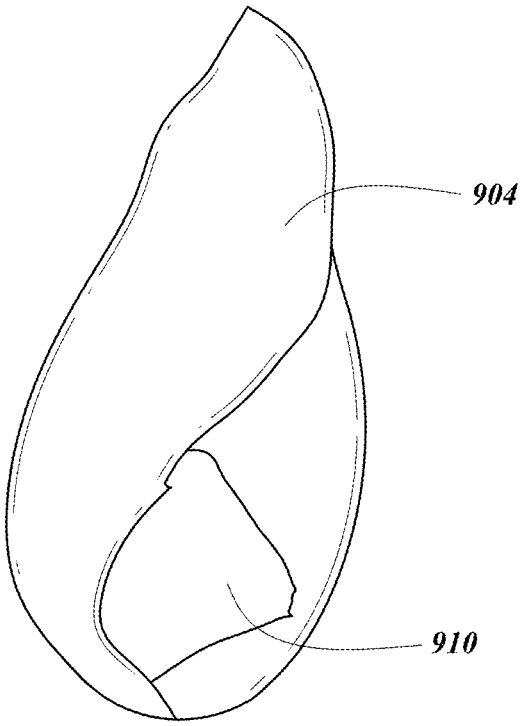
FIGS. 9A-9B depict various flower wrap layers folded over a core.
Figure 9B:
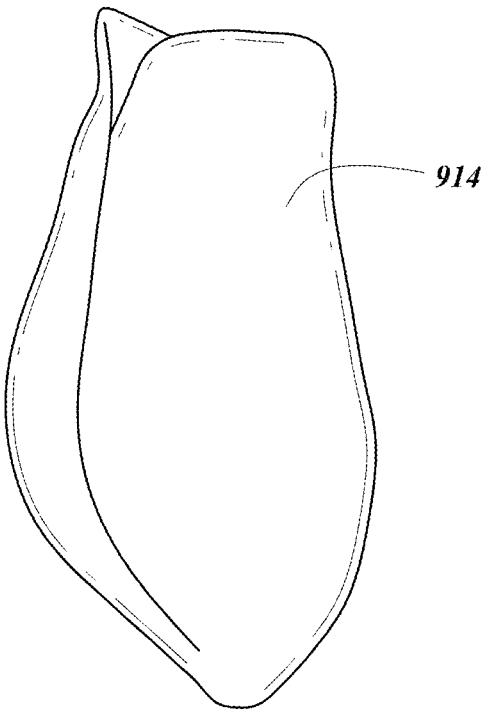

FIGS. 9A and 9B show that the core 910 may be wrapped partially 904 (shown in FIG. 9A) or completely 914 (shown in FIG. 9B) by a plurality of petals. In other embodiments, the inner core has other wrap covering techniques, such as a rolling method or a bundling method. In some embodiments, the inner artificial flower can be coreless.

Figure 10B:
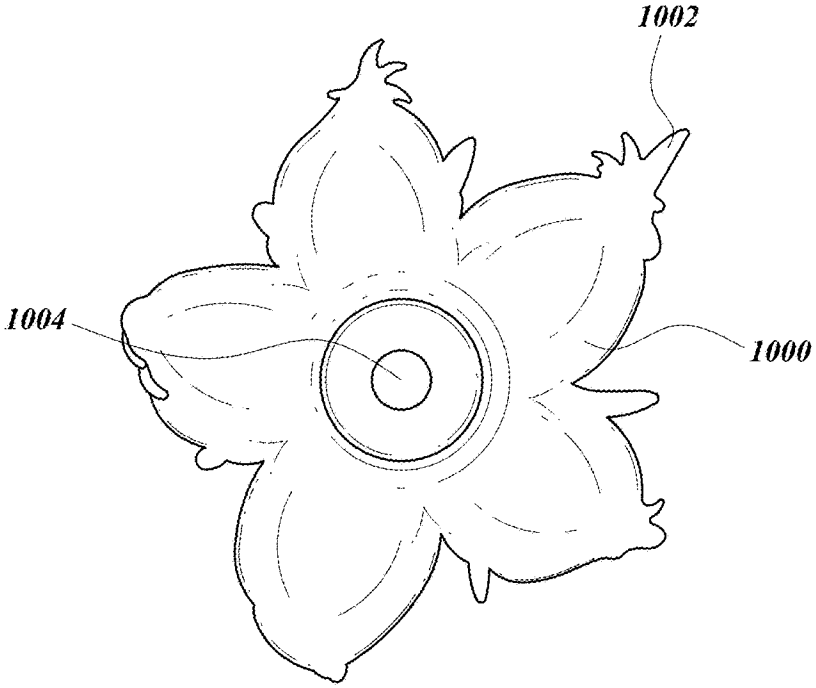
FIGS. 10A-10B depict views of an embodiment of a calyx.
Figure 10A:
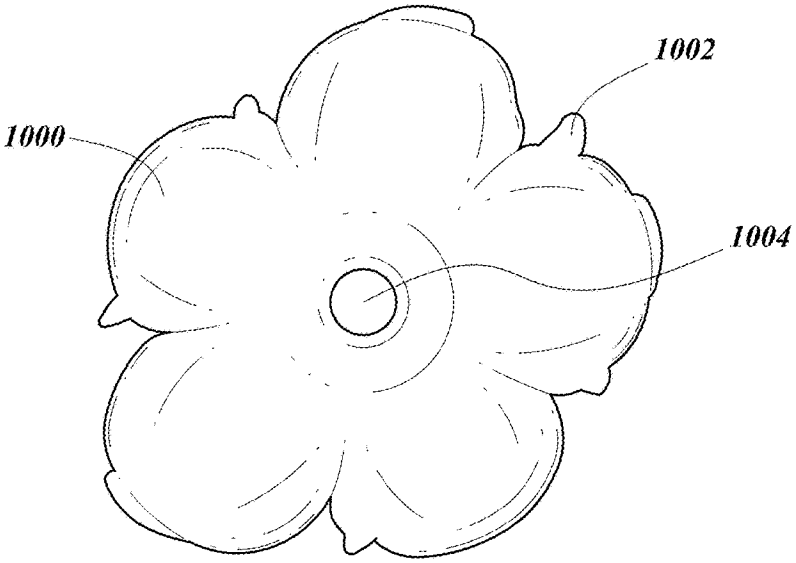

FIG. 10A shows an example calyx 1000 from a top view. FIG. 10B shows an example calyx 1000 from a bottom view. The calyx may be made of soap, plastic, foam, metal, wood, or any sturdy material. The calyx 1000 may have barbs 1002 for better attachment to soap flowers or for decoration. The calyx 1000 may have a hole 1004 to accept a wire or stem.

Figure 11:
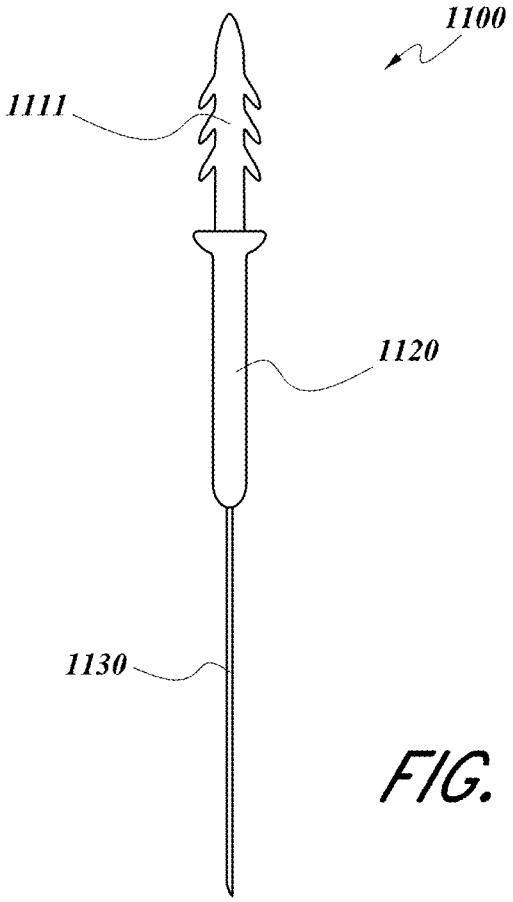
FIG. 11 depicts an embodiment of a flower mounter.

FIG. 11 shows a flower mounter 1100. The flower mounter 1100 may have a barb 1111, a calyx contact point 1120, and an optional stem 1130. The barb 1110 may have hooks that secure it to the artificial flower, e.g., to the core for the artificial flower. Adhesive, ridges, or bumps may also be used instead of barbs 1100. The optional stem 1130 may be wood, plastic, metal, or any other sturdy material. The optional stem may be inserted into the calyx contact point 1120.

Figure 12A:
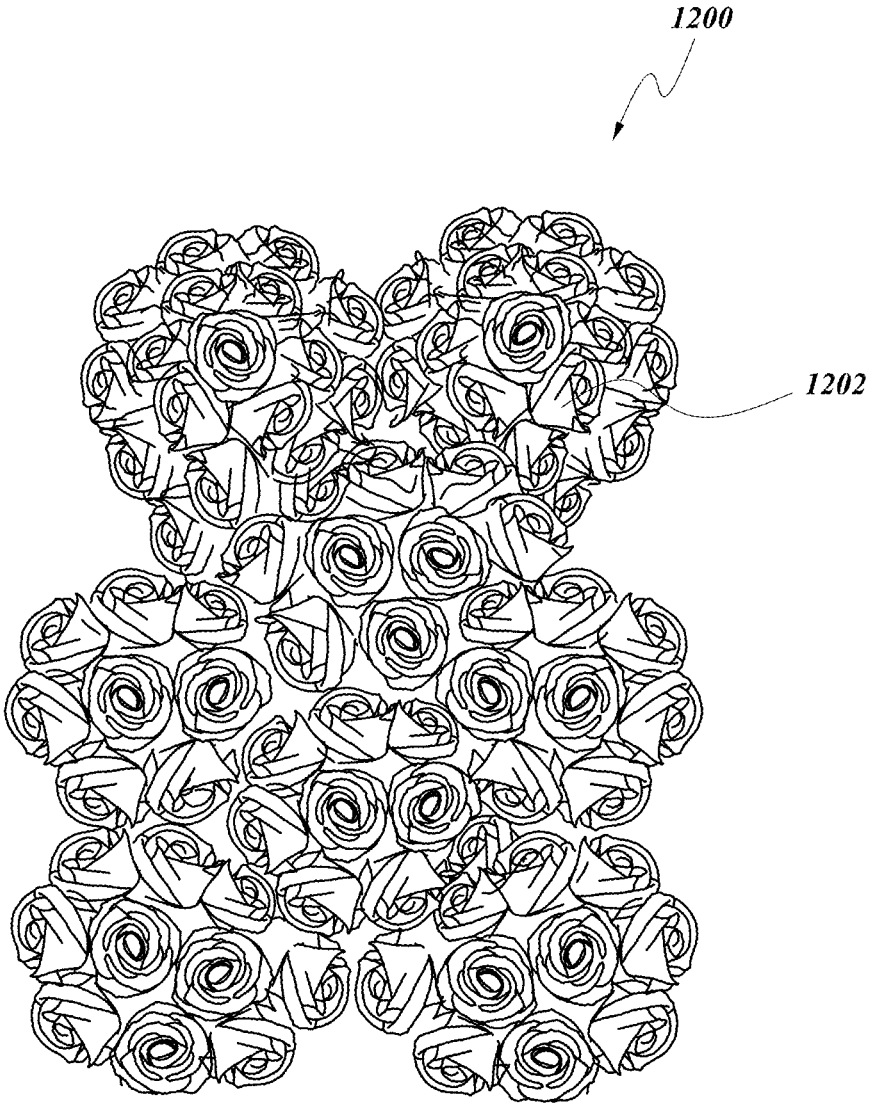
FIGS. 12A-12C depict various views of an example arrangement made out of soap flowers.
Figure 12B:
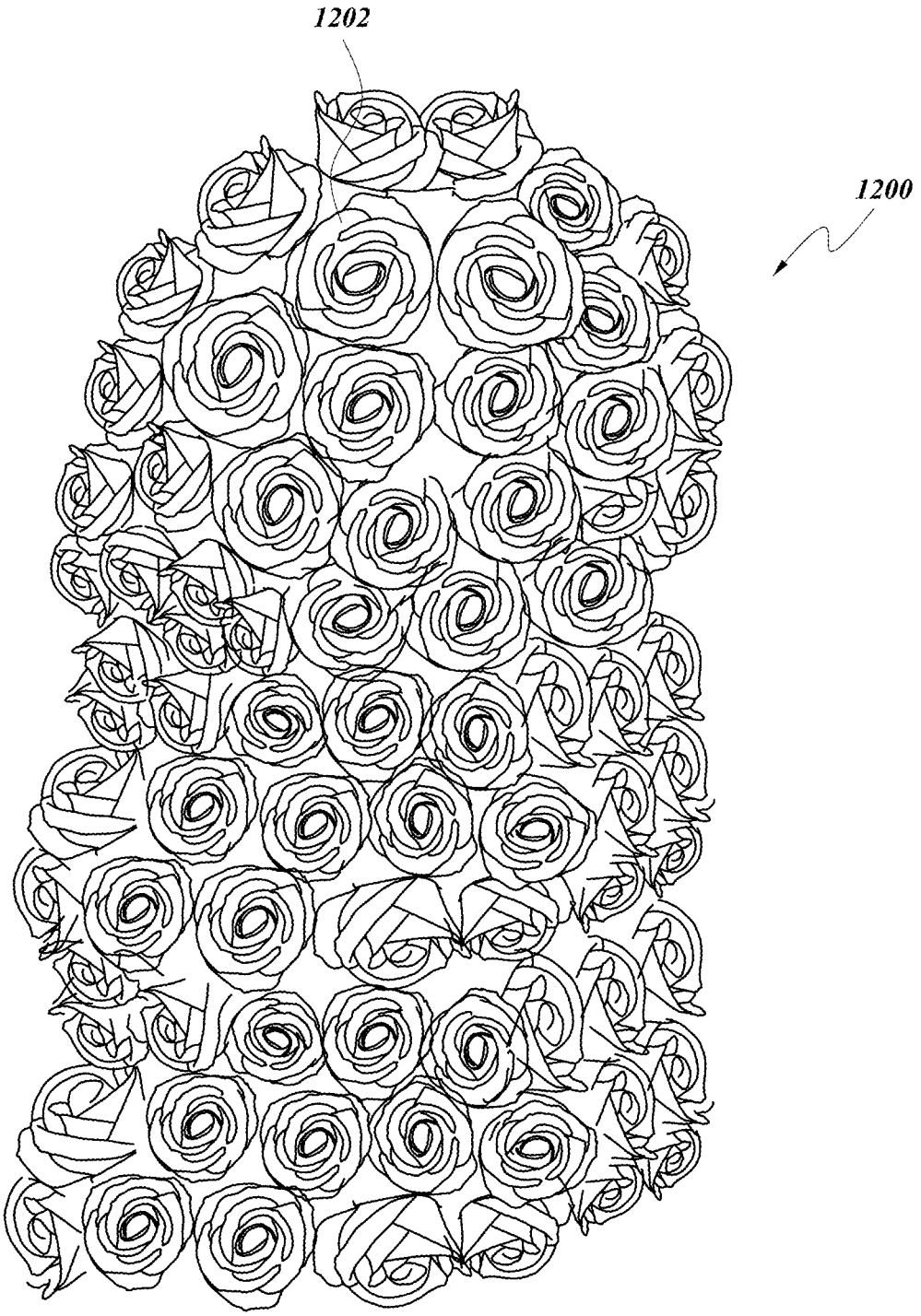
Figure 12C:
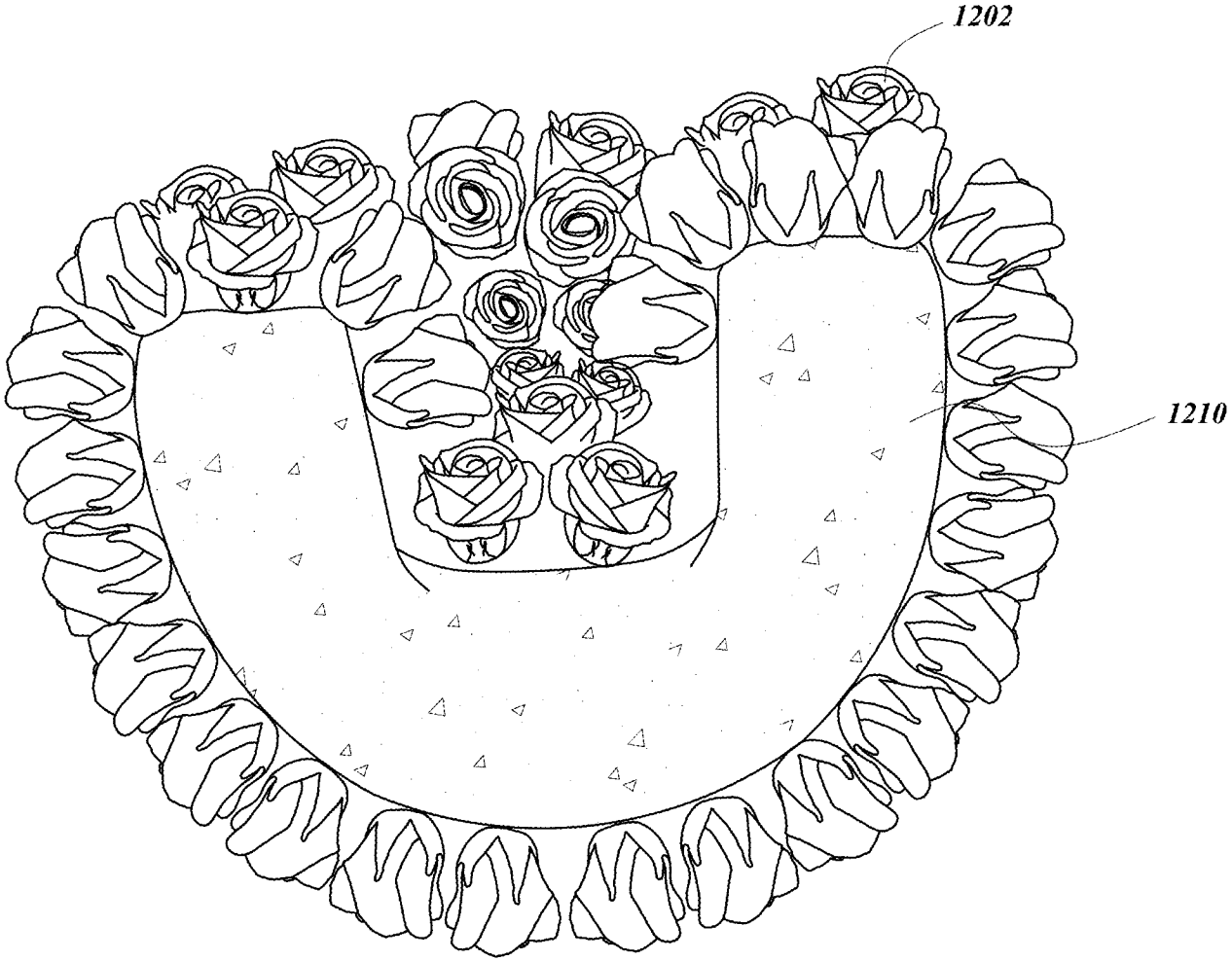

Artificial flowers formed using the methods disclosed herein may be used in arrangements. FIGS. 12A-12C show an example arrangement that is in the shape of a bear 1200. FIG. 12A shows a frontal view. FIG. 12B shows a side profile. FIG. 12C shows a bottom view. Arrangement shapes may include, but are not limited to, animals (e.g., dogs, cats, bears, birds, invertebrates, vertebrates), plants, cars, logos, designs, sports items, food items (e.g., cakes, candies, chocolates), figurines (e.g., cupid), and shapes (e.g., a heart, a letter, a box of chocolates, a Hershey's Kiss®). Floral arrangement foam 1210 or other porous material (e.g., sea sponge, artificial sponges, packed or loose sand, packed or lose gravel, packed or lose crystal grains) may be used to hold the soap flowers 1202.

Figure 13A:
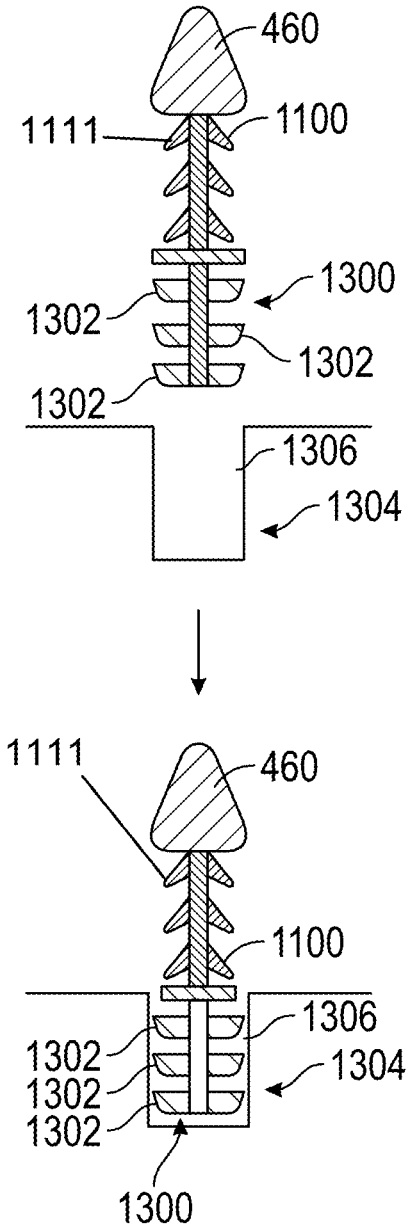
FIGS. 13A-13B depict embodiments of snap-lock ends.

As shown in the schematic view of FIG. 13A, in some embodiments, the flower mounter 1100 can comprise a snap-lock end 1300 which can include multiple radially extending grippers 1302 that grip into a substrate 1304 via friction fit when the snap-lock end 1300 is coupled with a preformed hole 1306, as well as barbs 1111 which can be as previously described. The snap-lock end 1300 design can allow a person to quickly and accurately assemble artificial flowers into a desired shape as long as the preformed holes 1306 have desired depths and configured to fit the grippers 1302 therein, and are spread out with predetermined separation. In some embodiments, the snap-lock end 1300 attaches or is integrally formed with the bottom of the flower mounter 1100. In some embodiments, the snap-lock end 1300 is a part of the flower mounter 1100. In some embodiments, the substrate 1304 has preformed holes 1306 fitted with a female connector or male connector that mates with male connector or female connector of the snap-lock end 1300, respectively. In some embodiments, the snap-lock end can be pushed into a substrate where grippers 1302 secure the snap lock end 1300 into the substrate 1304. In some embodiments, the snap-lock end 1300 is meant to inserted into the substrate 1304 or preformed hole 1306 permanently. In some embodiments, the snap-lock end 1300 can be removed with a mechanical force, but will not easily slide out of the substrate 1304 or preformed hole 1306. In some embodiments, the flower mounter 1100 can be inserted into a coreless artificial flower. In some embodiments, the flower mounter 1100 can be inserted into a core 460.

Figure 13B:
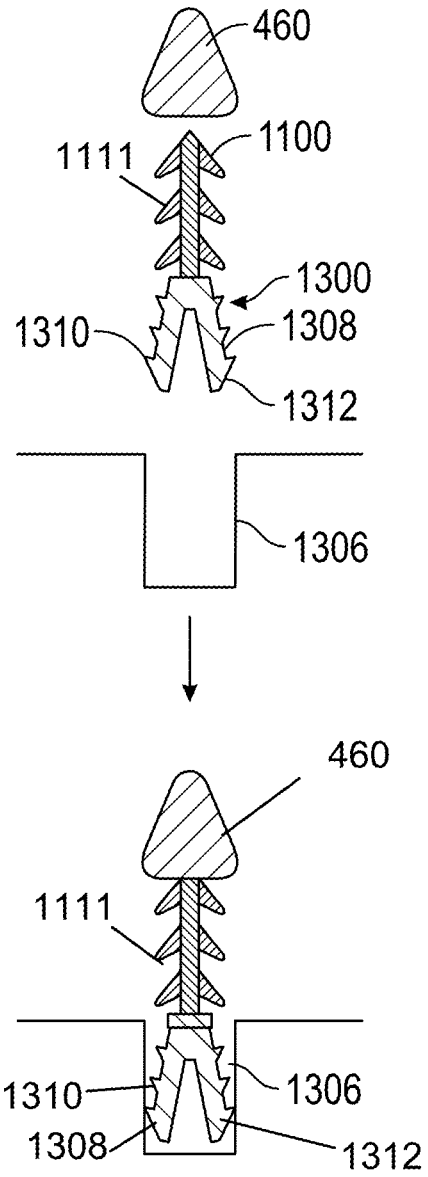

FIG. 13B shows an alternative embodiment of the snap-lock end 1300 that uses a dual barb prong design 1308. The dual barb prong design 1308 has 2, 3, or more barbs biased radially outwardly, and can allow a user to apply force to compress the prongs 1310, 1312 to form a tip that allows the snap-lock end 1300 to be inserted into a preformed hole 1306 or to burrow into a substrate 1304. Once the user releases the prongs 1310, 1312, the dual barb prong design returns to its open position where it then latches into its surroundings and can create a secure attachment. In some embodiments, the preformed holes 1306 can have inner rifling that can allow the snap-lock end 1300 to easily be inserted with a twisting insertion motion, and can prevent slippage or removal of the snap-lock end due to snagging of the snap-lock end with the rifling. In some embodiments the substrate can be the surface of a preformed arrangement design surface shaped like a dog, bear, horse, heart, or other type of design. In some embodiments, instead of a snap-lock design, the end of the stem 1130 can have a threaded design and the preformed hole 1306 can also be threaded to secure the stem 1130 or artificial flower contract to the substrate 1304. In some embodiments, instead of barbs, the flower mounter 1100 tip and core 460 can have a threaded design configured to secure the flower mounter 1100 into the core 460. In some embodiments, the flower mounter has an adhesive tip that adheres to the core 460, coreless flower 811, or to the artificial flower construct.

Figure 14A:
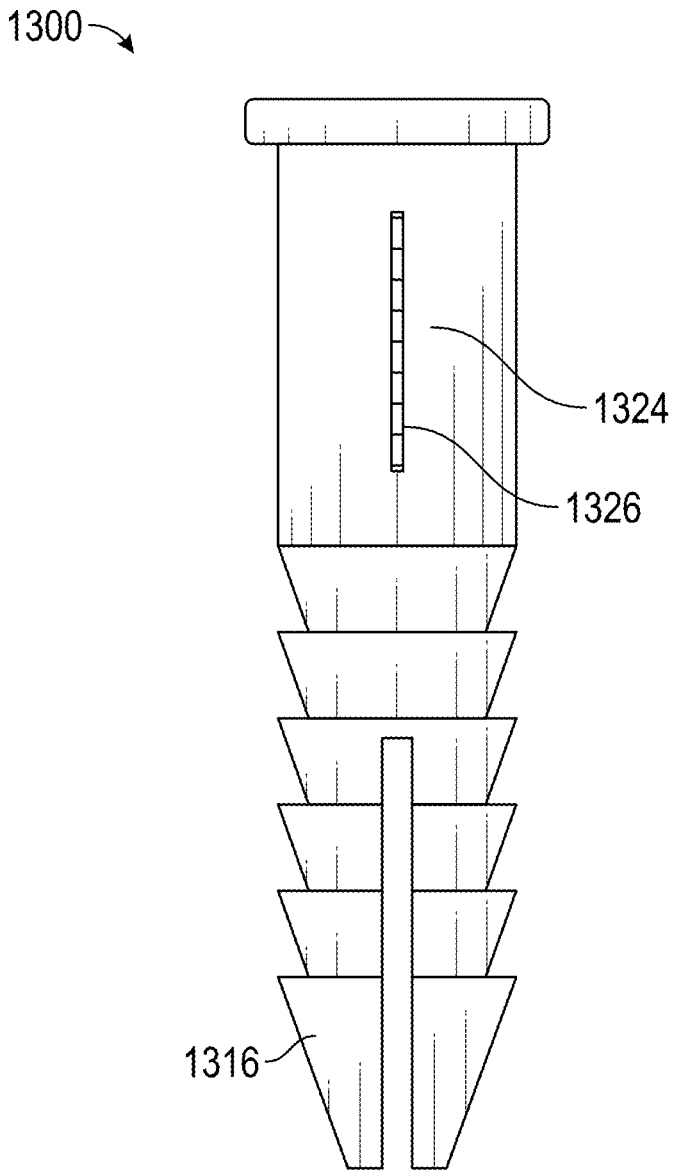
FIGS. 14A-14D show various views of a snap-lock end embodiment.
Figure 14B:
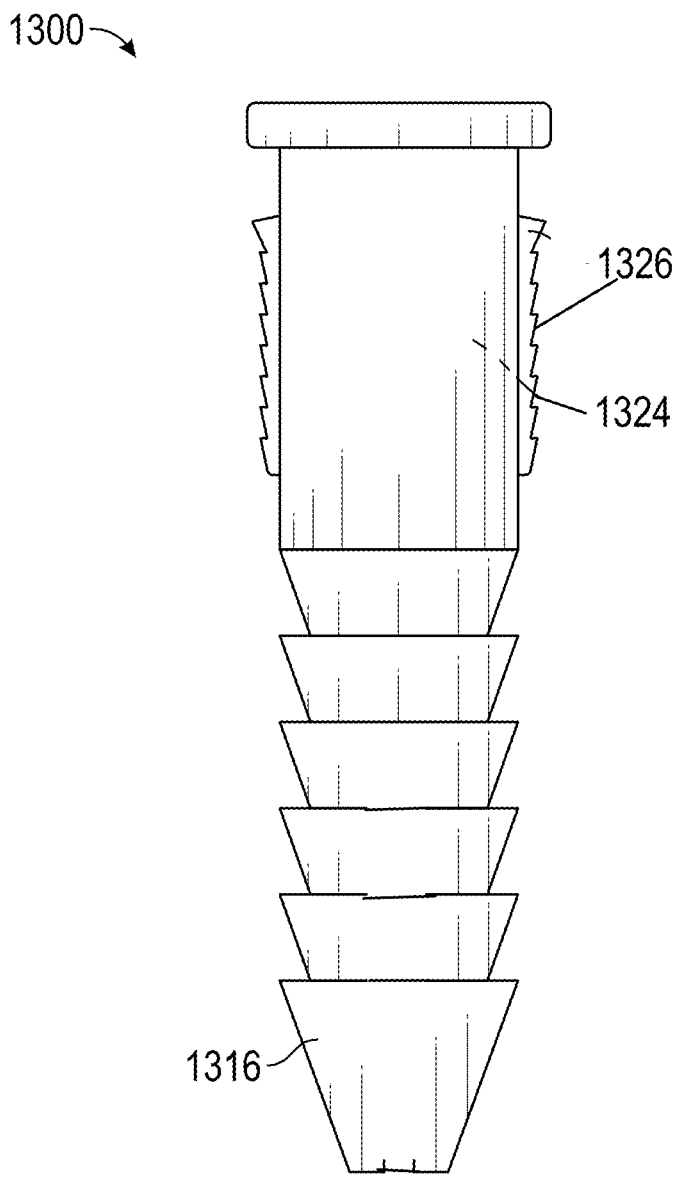
Figure 14C:
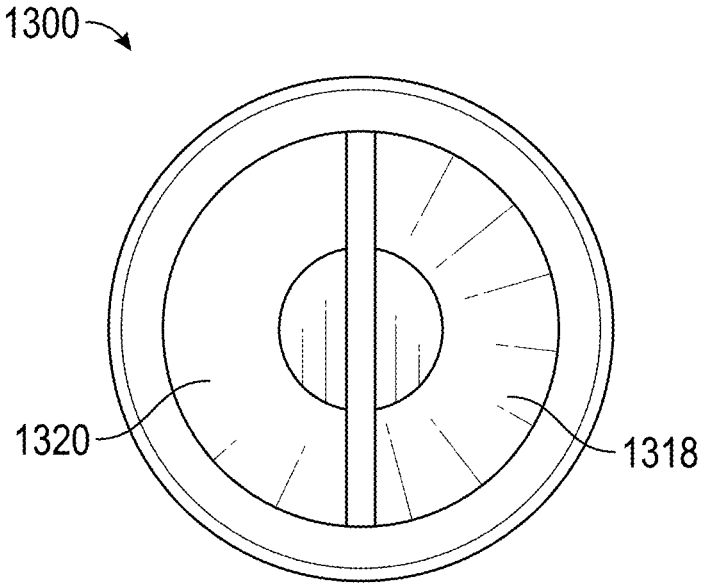
Figure 14D:
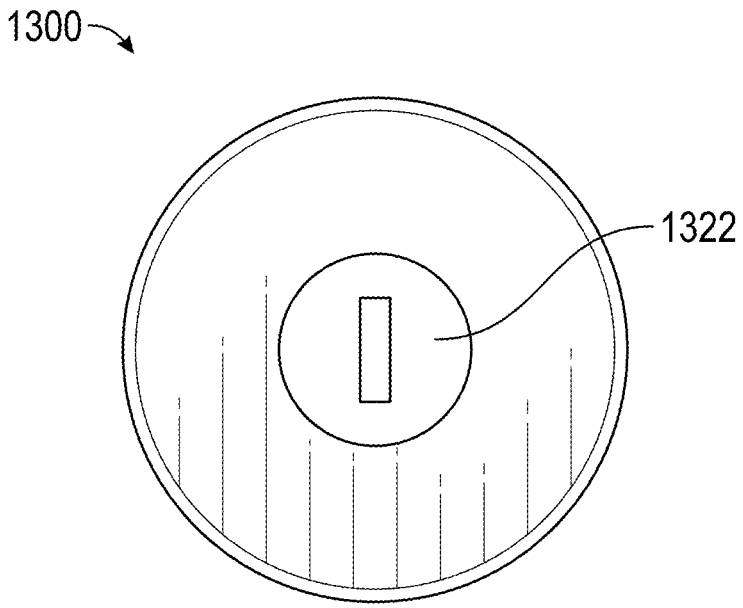

FIGS. 14A-D shows different perspective views of an alternative snap-lock end 1300 design that uses a hybrid-barbed design 1316 that can be attached to a flower mounter 1100 via a connection hole 1322. FIGS. 14A-B show different view of a side profile of the snap-lock end 1300. FIG. 14C shows a bottom view of the snap-lock end 1300. FIG. 14D shows a top view of the snap-lock end 1300. The hybrid-barbed design 1316 also has two prongs 1318, 1320 that can allow a user to compress the prongs radially inwardly so the snap-lock end 1300 can be inserted into a preformed hole and then return to its original radially outwardly biased orientation once a user removes the applied force. The hybrid-barbed design 1316 can also have wings 1324 that also have ridges 1326 that can aid in securing the snap-lock end 1300 into a substrate or preformed hole.

Terminology

Many other variations than those described herein will be apparent from this disclosure. For example, depending on the embodiment, certain acts, events, or functions of any of the steps described herein can be performed in a different sequence, can be added, merged, or left out altogether (e.g., not all described acts or events are necessary for the practice of the algorithms). Moreover, in certain embodiments, acts or events can be performed concurrently. In addition, different tasks or processes can be performed by different machines and/or computing systems that can function together.

The foregoing description and examples has been set forth merely to illustrate the disclosure and are not intended as being limiting. Each of the disclosed aspects and embodiments of the present disclosure may be considered individually or in combination with other aspects, embodiments, and variations of the disclosure. In addition, unless otherwise specified, none of the steps of the methods of the present disclosure are confined to any particular order of performance. Modifications of the disclosed embodiments incorporating the spirit and substance of the disclosure may occur to persons skilled in the art and such modifications are within the scope of the present disclosure. Furthermore, all references cited herein are incorporated by reference in their entirety.

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language used herein, such as, among others, "can," "might," "may," "e.g.," and the like, unless specifically stated otherwise, or otherwise understood within the context as used, is generally intended to convey that some embodiments include, while other embodiments do not include, certain features, elements, and/or states. Thus, such conditional language is not generally intended to imply that features, elements, blocks, and/or states are in any way required for one or more embodiments or that one or more embodiments necessarily include logic for deciding, with or without author input or prompting, whether these features, elements and/or states are included or are to be performed in any particular embodiment.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

Although systems and methods for and of making soap flowers and soap flowers have been disclosed in the context of certain embodiments and examples, this disclosure extends beyond the specifically disclosed embodiments to other alternative embodiments and/or uses of the embodiments and certain modifications and equivalents thereof. Various features and aspects of the disclosed embodiments can be combined with or substituted for one another in order to form varying modes of systems and methods for and of making soap flowers and soap flowers. The scope of this disclosure should not be limited by the particular disclosed embodiments described herein.

Certain features that are described in this disclosure in the context of separate implementations can be implemented in combination in a single implementation. Conversely, various features that are described in the context of a single implementation can be implemented in multiple implementations separately or in any suitable subcombination. Although features may be described herein as acting in certain combinations, one or more features from a claimed combination can, in some cases, be excised from the combination, and the combination may be claimed as any subcombination or variation of any subcombination.

While the methods and devices described herein may be susceptible to various modifications and alternative forms, specific examples thereof have been shown in the drawings and are herein described in detail. It should be understood, however, that the invention is not to be limited to the particular forms or methods disclosed, but, to the contrary, the invention is to cover all modifications, equivalents, and alternatives falling within the spirit and scope of the various embodiments described and the appended claims. Further, the disclosure herein of any particular feature, aspect, method, property, characteristic, quality, attribute, element, or the like in connection with an embodiment can be used in all other embodiments set forth herein. Any methods disclosed herein need not be performed in the order recited. Depending on the embodiment, one or more acts, events, or functions of any of the algorithms, methods, or processes described herein can be performed in a different sequence, can be added, merged, or left out altogether (e.g., not all described acts or events are necessary for the practice of the algorithm). In some embodiments, acts or events can be performed concurrently, e.g., through multi-threaded processing, interrupt processing, or multiple processors or processor cores or on other parallel architectures, rather than sequentially. Further, no element, feature, block, or step, or group of elements, features, blocks, or steps, are necessary or indispensable to each embodiment. Additionally, all possible combinations, subcombinations, and rearrangements of systems, methods, features, elements, modules, blocks, and so forth are within the scope of this disclosure. The use of sequential, or time-ordered language, such as "then," "next," "after," "subsequently," and the like, unless specifically stated otherwise, or otherwise understood within the context as used, is generally intended to facilitate the flow of the text and is not intended to limit the sequence of operations performed. Thus, some embodiments may be performed using the sequence of operations described herein, while other embodiments may be performed following a different sequence of operations.

Moreover, while operations may be depicted in the drawings or described in the specification in a particular order, such operations need not be performed in the particular order shown or in sequential order, and all operations need not be performed, to achieve the desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described herein should not be understood as requiring such separation in all implementations, and it should be understood that the described components and systems can generally be integrated together in a single product or packaged into multiple products. Additionally, other implementations are within the scope of this disclosure.

Some embodiments have been described in connection with the accompanying figures. Certain figures are drawn and/or shown to scale, but such scale should not be limiting, since dimensions and proportions other than what are shown are contemplated and are within the scope of the embodiments disclosed herein. Distances, angles, etc., are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

The methods disclosed herein may include certain actions taken by a practitioner; however, the methods can also include any third-party instruction of those actions, either expressly or by implication. For example, actions such as "positioning an electrode" include "instructing positioning of an electrode."

In summary, various embodiments and examples of systems and methods for and of making soap flowers and soap flowers have been disclosed. Although the systems and methods for and of making soap flowers and soap flowers have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Thus, the scope of this disclosure should not be limited by the particular disclosed embodiments described herein, but should be determined only by a fair reading of the claims that follow.

The ranges disclosed herein also encompass any and all overlap, sub-ranges, and combinations thereof. Language such as "up to," "at least," "greater than," "less than," "between," and the like includes the number recited. Numbers preceded by a term such as "about" or "approximately" include the recited numbers and should be interpreted based on the circumstances (e.g., as accurate as reasonably possible under the circumstances, for example ±5%, ±10%, ±15%, etc.). For example, "about 1 V" includes "1 V." Phrases preceded by a term such as "substantially" include the recited phrase and should be interpreted based on the circumstances (e.g., as much as reasonably possible under the circumstances). For example, "substantially perpendicular" includes "perpendicular." Unless stated otherwise, all measurements are at standard conditions including temperature and pressure.

What is claimed is:

1. A method of assembling an artificial flower, comprising:

stacking a plurality of pliable material sheets;

pressing a stamp into the plurality of pliable material sheets to produce a column of flower wraps, wherein the column of flower wraps comprises at least a first flower wrap and a second flower wrap, the stamp further comprising a shape corresponding to the first flower wrap and the second flower wrap;

separating a plurality of individual flower wraps from the column of flower wraps, wherein each flower wrap comprises a central hub and a plurality of petals, wherein the plurality of petals extends radially outward from the central hub, and the central hub and plurality of petals are integrally formed with each other; and creating an artificial flower construct, wherein creating the artificial flower construct comprises wrapping the plurality of petals of a first flower wrap of the plurality of flower wraps around the plurality of petals to make the artificial flower construct.

2. The method in claim 1, wherein the first flower wrap of the plurality of flower wraps are wrapped by folding each of the petals around a porous core.

3. The method of claim 1, wherein a second flower wrap of the plurality of flower wraps is layered around the first flower wrap of the plurality of flower wraps and each of the petals of the second flower wrap of the plurality of flower wraps are folded around the first flower wrap to make a two layer artificial flower.

4. The method of claim 3, wherein a third flower wrap of the plurality of flower wraps is layered around the second flower wrap of the plurality of flower wraps and each of the petals of the third flower wrap of the plurality of flower wraps are folded around the second flower wrap of the plurality of flower wraps to make a three layer artificial flower.

5. The method of claim 1, further comprises inserting a flower mounter into the artificial flower construct.

6. The method of claim 5, wherein the flower mounter comprises a snap-lock end that is configured to couple to a preformed hole of a substrate.

7. The method in claim 1, wherein the pliable material sheets comprises flame retardant material.

8. The method in claim 2, wherein the core comprises flame retardant material.

9. An artificial flower created by the method of claim 2.

10. An artificial flower comprising:

a first flower wrap comprising a pliable material made from a first stamp comprising a first central hub and a first plurality of petals, wherein the first plurality of petals extends radially outward from the first central hub, and the first central hub and first plurality of petals are integrally formed with each other;

a second flower wrap comprising the pliable material made from a second stamp comprising a second central hub and a second plurality of petals, wherein the second plurality of petals extends radially outward from the second central hub, and the second central hub and second plurality of petals are integrally formed with each other; and a third flower wrap comprising the pliable material made from a third stamp comprising a third central hub and a third plurality of petals, wherein the third plurality of petals extends radially outward from the third central hub, and the third central hub and third plurality of petals are integrally formed with each other; and a porous core, wherein the first plurality of petals of the first flower wrap are wrapped around the porous core each other to make an artificial flower construct, the second plurality of petals of the second flower wrap are wrapped and folded over the artificial construct, and the third plurality of petals of the third flower wrap are wrapped and folded over the second flower wrap, wherein the core is configured such that part of the artificial flower can be inserted through the porous core.

11. The artificial flower of claim 10, wherein the artificial flower further comprises a calyx attached to the third flower wrap.

12. The artificial flower of claim 10, wherein the artificial flower further comprises a flower mounter that is inserted into the artificial construct.

13. The artificial flower of claim 12, wherein the flower mounter comprises a snap-lock end that is configured to couple to a preformed hole of a substrate.

14. The artificial flower of claim 10, wherein the pliable material comprises flame retardant material.

15. The artificial flower of claim 10, wherein the core comprises flame retardant material.

16. The artificial flower of claim 10, wherein the pliable material comprises soap.

17. The artificial flower of claim 10, wherein the core comprises foam.

18. The artificial flower of claim 10, wherein the core comprises sponge material.

19. The artificial flower of claim 10, wherein the core comprises styrofoam.

20. An artificial flower comprising:

a first flower wrap comprising a pliable material made from a first stamp comprising a first central hub and a first plurality of petals, wherein the first plurality of petals extends radially outward from the first central hub, and the first central hub and first plurality of petals are integrally formed with each other;

a second flower wrap comprising the pliable material made from a second stamp comprising a second central hub and a second plurality of petals, wherein the second plurality of petals extends radially outward from the second central hub, and the second central hub and second plurality of petals are integrally formed with each other; and a third flower wrap comprising the pliable material made from a third stamp comprising a third central hub and a third plurality of petals, wherein the third plurality of petals extends radially outward from the third central hub, and the third central hub and third plurality of petals are integrally formed with each other; and a core comprising a flower mounter inserted through at least a portion of the core, wherein the first plurality of petals of the first flower wrap are wrapped around the core each other to make an artificial flower construct, the second plurality of petals of the second flower wrap are wrapped and folded over the artificial construct, and the third plurality of petals of the third flower wrap are wrapped and folded over the second flower wrap.

* * * * *